US010695779B2

(12) United States Patent
Saine et al.

(10) Patent No.: US 10,695,779 B2
(45) Date of Patent: Jun. 30, 2020

(54) APPLICATOR HAVING ACTIVE BACKPRESSURE CONTROL DEVICES

(71) Applicant: NORDSON CORPORATION, Westlake, OH (US)

(72) Inventors: Joel E. Saine, Dahlonega, GA (US); Leslie J. Varga, Cumming, GA (US)

(73) Assignee: Nordson Corporation, Westlake, OH (US)

( * ) Notice: Subject to any disclaimer, the term of this patent is extended or adjusted under 35 U.S.C. 154(b) by 0 days.

(21) Appl. No.: 16/378,186

(22) Filed: Apr. 8, 2019

(65) Prior Publication Data

US 2019/0232309 A1 Aug. 1, 2019

Related U.S. Application Data

(63) Continuation-in-part of application No. 15/698,036, filed on Sep. 7, 2017, now Pat. No. 10,272,464.

(Continued)

(51) Int. Cl.

| | |
|---|---|
| ***B05B 9/04*** | (2006.01) |
| ***F04B 23/04*** | (2006.01) |
| ***B05C 5/02*** | (2006.01) |
| ***F04B 13/00*** | (2006.01) |
| ***B05C 11/10*** | (2006.01) |

(Continued)

(52) U.S. Cl.

CPC ..... *B05B 9/0406* (2013.01); *B01F 5/108* (2013.01); *B05C 5/001* (2013.01); *B05C 5/0279* (2013.01); *B05C 11/1013* (2013.01); *F04B 13/00* (2013.01); *F04B 23/04* (2013.01); *F04B 49/20* (2013.01); *B01F 5/14* (2013.01); *B05C 11/1026* (2013.01); *B05C 11/1042* (2013.01);

(Continued)

(58) Field of Classification Search

USPC ..... 156/578

See application file for complete search history.

(56) References Cited

U.S. PATENT DOCUMENTS

| | | | |
|---|---|---|---|
| 5,228,594 | A | 7/1993 | Aslin |
| 5,236,641 | A | 8/1993 | Allen et al. |

(Continued)

FOREIGN PATENT DOCUMENTS

| | | | |
|---|---|---|---|
| DE | 4121792 | A1 | 1/1993 |
| DE | 202004001480 | U1 | 4/2004 |

(Continued)

OTHER PUBLICATIONS

ISA/220—Notification of Transmittal or Search Report and Written Opinion of the ISA, or the Declaration dated Jan 8, 2018 for WO Application No. PCT/US17/050380.

(Continued)

*Primary Examiner* — Sing P Chan

(74) *Attorney, Agent, or Firm* — Baker & Hostetler LLP

(57) ABSTRACT

The present disclosure describes a method and system for controlling dispensing of adhesive from an applicator. The method includes pumping adhesive from a plurality of pump assemblies to a plurality of dispensing modules and measuring current draw from each of the plurality of pump assemblies. The method also includes determining an adjustment to an operating speed of each of the plurality of pump assemblies individually based on their respective current draws and adjusting the operating speed of each of the plurality of pump assemblies individually.

25 Claims, 17 Drawing Sheets

Related U.S. Application Data

(60) Provisional application No. 62/385,238, filed on Sep. 8, 2016.

(51) Int. Cl.

| | |
|---|---|
| ***F04B 49/20*** | (2006.01) |
| ***B05C 5/00*** | (2006.01) |
| ***B01F 5/10*** | (2006.01) |
| ***B01F 5/14*** | (2006.01) |

(52) U.S. Cl.
CPC ... *F04B 2203/0207* (2013.01); *F04B 2205/05* (2013.01); *F04B 2205/09* (2013.01)

(56) References Cited

U.S. PATENT DOCUMENTS

| | | | | |
|---|---|---|---|---|
| 5,409,642 | A | 4/1995 | Allen et al. | |
| 5,620,315 | A | 4/1997 | Pfuhler | |
| 5,632,938 | A | 5/1997 | Buehning | |
| 5,727,933 | A | 3/1998 | Laskaris et al. | |
| 5,862,986 | A | 1/1999 | Bolyard et al. | |
| 6,089,413 | A | 7/2000 | Riney et al. | |
| 6,210,141 | B1 | 4/2001 | Allen | |
| 6,296,463 | B1 | 10/2001 | Allen | |
| 6,422,428 | B1 | 7/2002 | Allen et al. | |
| 6,517,891 | B1 | 2/2003 | Estelle et al. | |
| 6,607,104 | B2 | 8/2003 | McGuffey | |
| 6,688,498 | B1 | 2/2004 | McGuffey | |
| 7,699,243 | B2 | 4/2010 | Starke | |
| 7,908,997 | B2 | 3/2011 | Lessley et al. | |
| 8,445,061 | B2 | 5/2013 | McGuffey | |
| 8,561,656 | B2 | 10/2013 | Eginton et al. | |
| 9,126,222 | B2 | 9/2015 | McGuffey | |
| 9,415,415 | B1 | 8/2016 | Jones | |
| 9,427,766 | B2 | 8/2016 | Varga | |
| 9,573,159 | B2 | 2/2017 | McGuffey | |
| 9,889,599 | B2 | 2/2018 | Ayers | |
| 9,925,552 | B2 | 3/2018 | Saine | |
| 2001/0024618 | A1 | 9/2001 | Winmill | |
| 2002/0102324 | A1 | 8/2002 | Groleau | |
| 2002/0139818 | A1 | 10/2002 | McGuffey | |
| 2003/0062384 | A1 | 4/2003 | McGuffey | |
| 2004/0099752 | A1 | 5/2004 | Boger | |
| 2004/0124251 | A1 | 7/2004 | Gressett et al. | |
| 2004/0159672 | A1 | 8/2004 | Auber et al. | |
| 2005/0230423 | A1 | 10/2005 | Riney et al. | |
| 2005/0242108 | A1 | 11/2005 | Harris et al. | |
| 2005/0274317 | A1 | 12/2005 | De et al. | |
| 2006/0182887 | A1 | 8/2006 | Miller | |
| 2008/0135650 | A1 | 6/2008 | Starke | |
| 2009/0266844 | A1 | 10/2009 | McGuffey | |
| 2012/0048447 | A1 | 3/2012 | Burmester et al. | |
| 2013/0108494 | A1 | 5/2013 | Varga | |
| 2015/0190837 | A1 | 7/2015 | Burmester et al. | |
| 2015/0352588 | A1 | 12/2015 | Lessley et al. | |
| 2016/0256889 | A1 | 9/2016 | Jones | |
| 2016/0303597 | A1 | 10/2016 | McGuffey | |
| 2017/0072624 | A1 | 3/2017 | Ayers | |
| 2017/0097019 | A1 | 4/2017 | Afshari | |
| 2017/0146035 | A1 | 5/2017 | Afshari | |
| 2018/0065137 | A1 | 3/2018 | Saine | |
| 2018/0065139 | A1 | 3/2018 | Saine | |
| 2018/0065140 | A1 | 3/2018 | Saine et al. | |
| 2018/0252213 | A1* | 9/2018 | Afshari | F04C 11/00 |
| 2018/0266415 | A1* | 9/2018 | Afshari | F15B 15/18 |
| 2018/0291895 | A1* | 10/2018 | Afshari | F04B 9/105 |
| 2019/0299237 | A1* | 10/2019 | Scharen | B42C 9/0006 |

FOREIGN PATENT DOCUMENTS

| | | | |
|---|---|---|---|
| EP | 1442798 | A2 | 8/2004 |
| EP | 2289633 | A2 | 3/2011 |
| EP | 3064279 | A1 | 9/2016 |
| EP | 3064280 | A1 | 9/2016 |
| JP | 09-173917 | A | 7/1997 |
| WO | 93/05212 | A2 | 3/1993 |
| WO | 99/54044 | A1 | 10/1999 |
| WO | 99/54055 | A1 | 10/1999 |
| WO | 20071084891 | A2 | 7/2007 |
| WO | 20111008390 | A1 | 1/2011 |
| WO | 2011/025603 | A1 | 3/2011 |

OTHER PUBLICATIONS

ISA/220—Notification of Transmittal or Search Report and Written Opinion of the ISA, or the Declaration dated Dec 20, 2017 for WO Application No. PCT/US17/050373.

ISA/220—Notification of Transmittal or Search Report and Written Opinion of the ISA, or the Declaration dated Dec 20, 2017 for WO Application No. PCT/US17/050368.

ISA/206—Invitation to Pay Additional Fees dated Jan 5, 2018 for WO Application No. PCT/US17/50406.

International Patent Application No. PCT/US2017/050406; Int'l Search Report and the Written Opinion; dated Mar. 19, 2018; 19 pages.

English Translation of International Preliminary Report on Patentability Chapter II or English Translation of International Preliminary Report on Patentability Chapter I dated Mar 21, 2019 for WO Application No. PCT/US17/050373.

English Translation of International Preliminary Report on Patentability Chapter II or English Translation of International Preliminary Report on Patentability Chapter I dated Mar 21, 2019 for WO Application No. PCT/US17/050368.

English Translation of International Preliminary Report on Patentability Chapter II or English Translation of International Preliminary Report on Patentability Chapter I dated Dec 13, 2018 for WO Application No. PCT/US17/050417.

(IPEA/409) International Preliminary Report on Patentability Chapter II or (IB/373) International Preliminary Report on Patentability Chapter I dated Mar 21, 2019 for WO Application No. PCT/US17/050509.

(IPEA/409) International Preliminary Report on Patentability Chapter II or (IB/373) International Preliminary Report on Patentability Chapter I dated Mar 21, 2019 for WO Application No. PCT/US17/050406.

(IPEA/409) International Preliminary Report on Patentability Chapter II or (IB/373) International Preliminary Report on Patentability Chapter I dated Mar 21, 2019 for WO Application No. PCT/US17/050380.

(IPEA/409) International Preliminary Report on Patentability Chapter II or (IB/373) International Preliminary Report on Patentability Chapter I dated Mar 21, 2019 for WO Application No. PCT/US17/050373.

(IPEA/409) International Preliminary Report on Patentability Chapter II or (IB/373) International Preliminary Report on Patentability Chapter I mailed on Mar 21, 2019 for WO Application No. PCT/US17/050368.

(IPEA/408) Written opinion under Chapter II dated Aug 3, 2018 for WO Application No. PCT/US17/050417.

* cited by examiner

APPLICATOR HAVING ACTIVE BACKPRESSURE CONTROL DEVICES

CROSS REFERENCE TO RELATED APPLICATIONS

This application is a continuation-in-part of U.S. patent application Ser. No. 15/698,036, filed Sep. 7, 2017, which claims the benefit of U.S. Provisional Patent App. No. 62/385,238, filed Sep. 8, 2016, the disclosures of which are hereby incorporated by reference herein in their entireties.

TECHNICAL FIELD

The present invention relates to an applicator for dispensing an adhesive onto a substrate and components for controlling the pump assemblies of the applicator.

BACKGROUND

Typical applicators for dispensing adhesive may include a plurality of dispensing modules for dispensing the adhesive onto a substrate. Such applicators also typically include a single drive that powers a single pump assembly or a plurality of pump assemblies that pump the material through the applicator. During operation, the applicator may be monitored in order to detect any changes in the flow of adhesive through the applicator, such that an operator of the applicator can respond accordingly. These changes may result from problems occurring within the applicator, such as clogs, worn parts, etc. Additionally, these changes may result from inconsistencies in the physical qualities of the adhesive being provided to the applicator, as it is not uncommon for a supplier to provide a solid material having physical characteristics that are slightly inconsistent within batches or between separate batches. However, given that a single drive may be pumping the adhesive to each of the plurality of dispensing modules, it may take a substantial amount of time after an adhesive flow change occurs within the applicator for the system to detect the change and for an appropriate response to be enacted. This can result in dispensing inconsistencies and inaccuracies, which can create a high amount of wasted products.

Therefore, there is a need for an applicator for dispensing adhesive that monitors the flow of adhesive within the applicator and allows for adjustments to the operation of the pump assemblies of the applicator to be made quickly after a change within the applicator occurs.

SUMMARY

An embodiment of the present disclosure is a dispensing system for dispensing adhesive. The dispensing system includes an applicator comprising a manifold, a plurality of dispensing modules coupled to said manifold, and a plurality of pump assemblies, where each of the plurality of pump assemblies is configured to pump the adhesive to a respective one of the plurality of dispensing modules at a respective operating speed. The dispensing system also includes a controller in signal communication with the applicator, where the controller is configured to a) measure current draw from each of the plurality of pump assemblies, b) determine an adjustment to the operating speed of each of the plurality of pump assemblies individually based on their respective current draws, and c) direct each of the plurality of pump assemblies to individually adjust their operating speed.

Another embodiment of the present disclosure is a method of controlling dispensing of adhesive from an applicator. The method includes pumping adhesive from a plurality of pump assemblies to a plurality of dispensing modules and measuring current draw from each of the plurality of pump assemblies. The method also includes determining an adjustment to an operating speed of each of the plurality of pump assemblies individually based on their respective current draws and adjusting the operating speed of each of the plurality of pump assemblies individually.

BRIEF DESCRIPTION OF THE DRAWINGS

The foregoing summary, as well as the following detailed description, will be better understood when read in conjunction with the appended drawings. The drawings show illustrative embodiments of the invention. It should be understood, however, that the application is not limited to the precise arrangements and instrumentalities shown.

DETAILED DESCRIPTION OF ILLUSTRATIVE EMBODIMENTS

Figure 1:
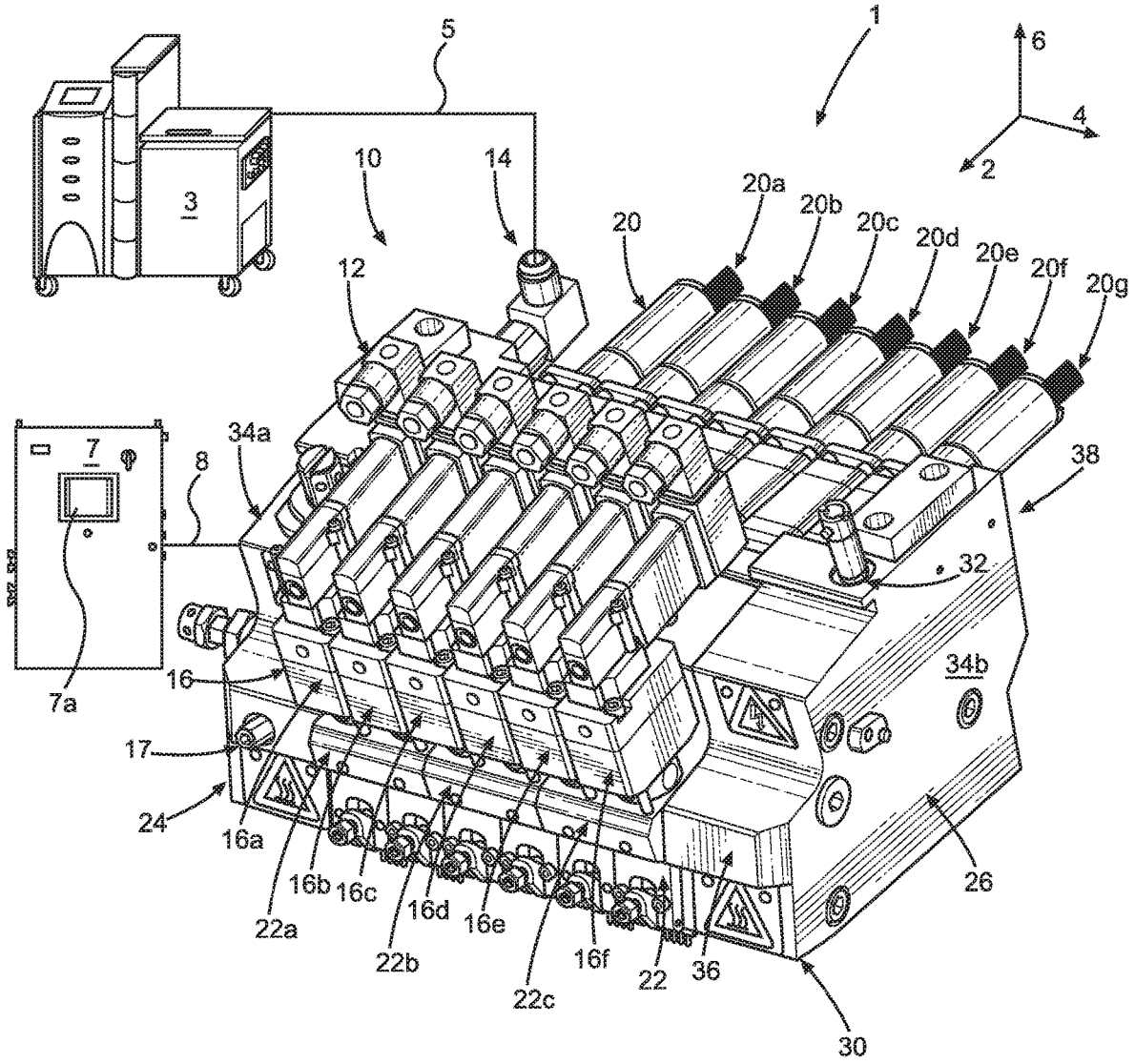
FIG. 1 is a front perspective view of a dispensing system according to an embodiment of the present invention.

Described herein is a dispensing system 1 including an applicator 10 that includes dispensing modules **16*a*-16*f*, pump assemblies 20***a*-20*g*, and a controller 7 for controlling the pump assemblies 20*a*-20*g*. Certain terminology is used to describe the dispensing system 1 in the following description for convenience only and is not limiting. The words "right," "left," "lower," and "upper" designate directions in the drawings to which reference is made. The words "inner" and "outer" refer to directions toward and away from, respectively, the geometric center of the description to describe the dispensing system 1 and related parts thereof. The words "forward" and "rearward" refer to directions in a longitudinal direction 2 and a direction opposite the longitudinal direction 2 along the dispensing system 1 and related parts thereof. The terminology includes the above-listed words, derivatives thereof, and words of similar import.

Unless otherwise specified herein, the terms "longitudinal," "transverse," and "lateral" are used to describe the orthogonal directional components of various components of the dispensing system 1, as designated by the longitudinal direction 2, lateral direction 4, and transverse direction 6. It should be appreciated that while the longitudinal and lateral directions 2 and 4 are illustrated as extending along a horizontal plane, and the transverse direction 6 is illustrated as extending along a vertical plane, the planes that encompass the various directions may differ during use.

Embodiments of the present invention include a dispensing system 1 that includes an applicator 10 for dispensing adhesive onto a substrate during product manufacturing. Referring to FIGS. 1-5, the applicator 10 includes a manifold 12. The applicator 10 has a top surface 32, a bottom surface 30 opposite the top surface 32 along the transverse direction 6, a first side surface 34*a*, a second side surface 34*b* opposite the first side surface 34*a* along the lateral direction 4, a front surface 36, and a back surface 38 opposite the front surface 36 along the longitudinal direction 2. The first and second side surfaces 34*a* and 34*b* extend from the front surface 36 to the back surface 38, as well as from the bottom surface 30 to the top surface 32. The manifold 12 is defined by a first end plate 24, a second end plate 26, and at least one manifold segment 22 disposed between the first and second end plates 24 and 26. As a result, the first and second end plates 24 and 26 are spaced apart along the lateral direction 4. The first and second end plates 24 and 26 and the manifold segments 22 may be releasably connected such that manifold segments 22 may be added or taken away from the applicator 10 as operating conditions require. As a result, even though FIGS. 1-5 show applicator 10 as including three manifold segments 22*a*-22*c*, applicator 10 can include more or less manifold segments 22 may as desired. However, in another embodiment, the manifold 12 may be a unitary manifold.

Figure 2:
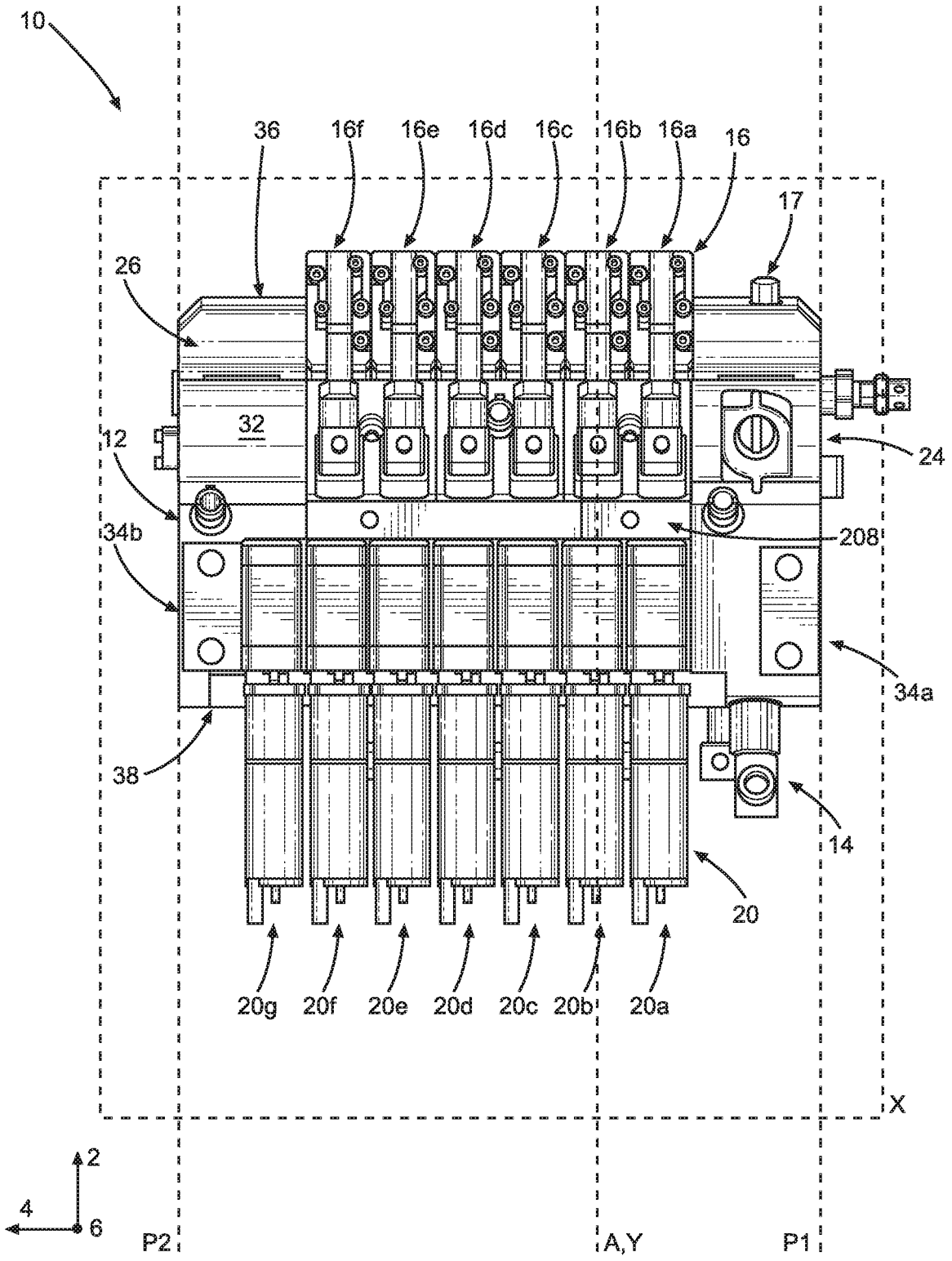
FIG. 2 is a top view of an applicator of the dispensing system shown in FIG. 1.
Figure 3:
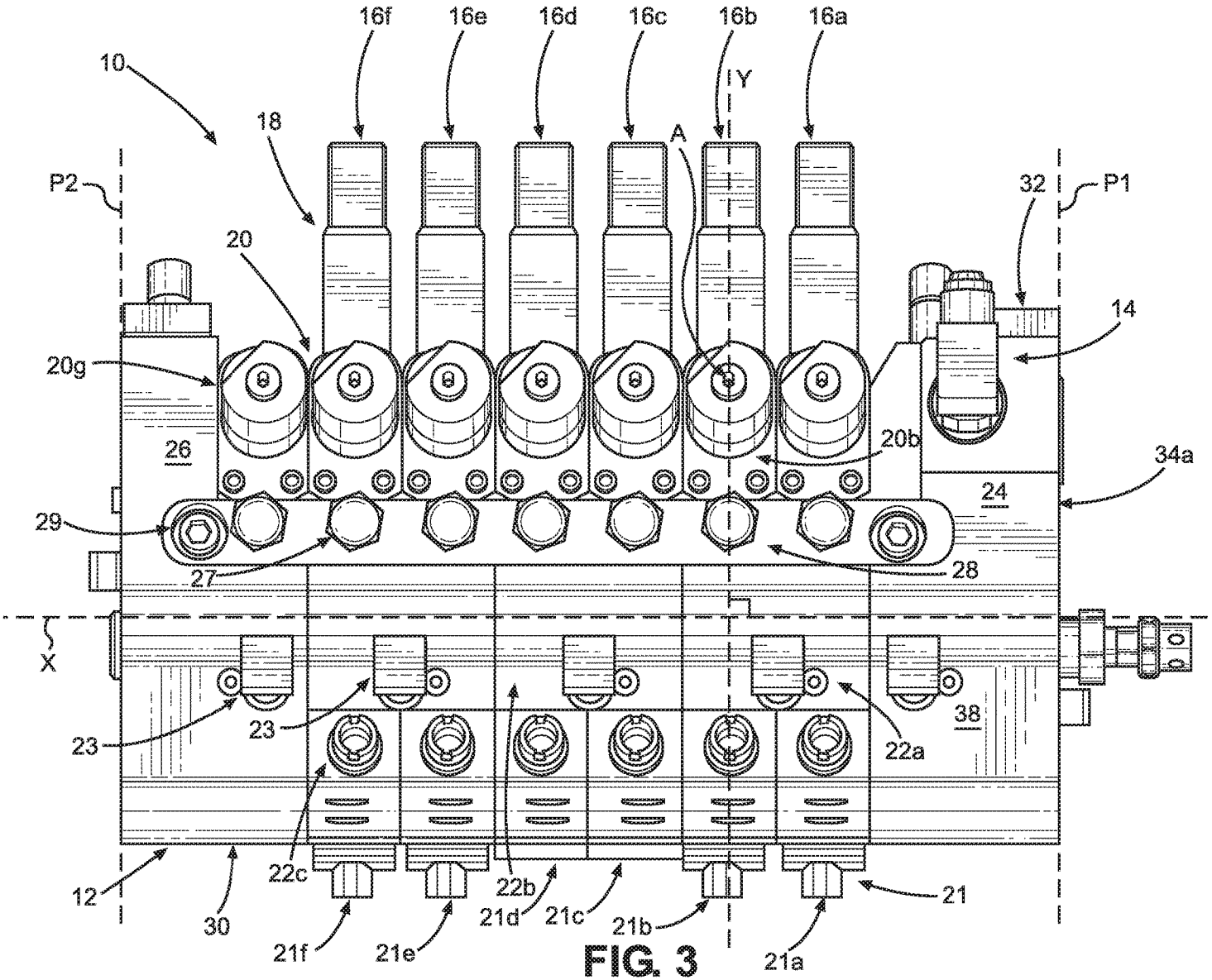
FIG. 3 is a rear view of the applicator shown in FIG. 1.
Figure 4:
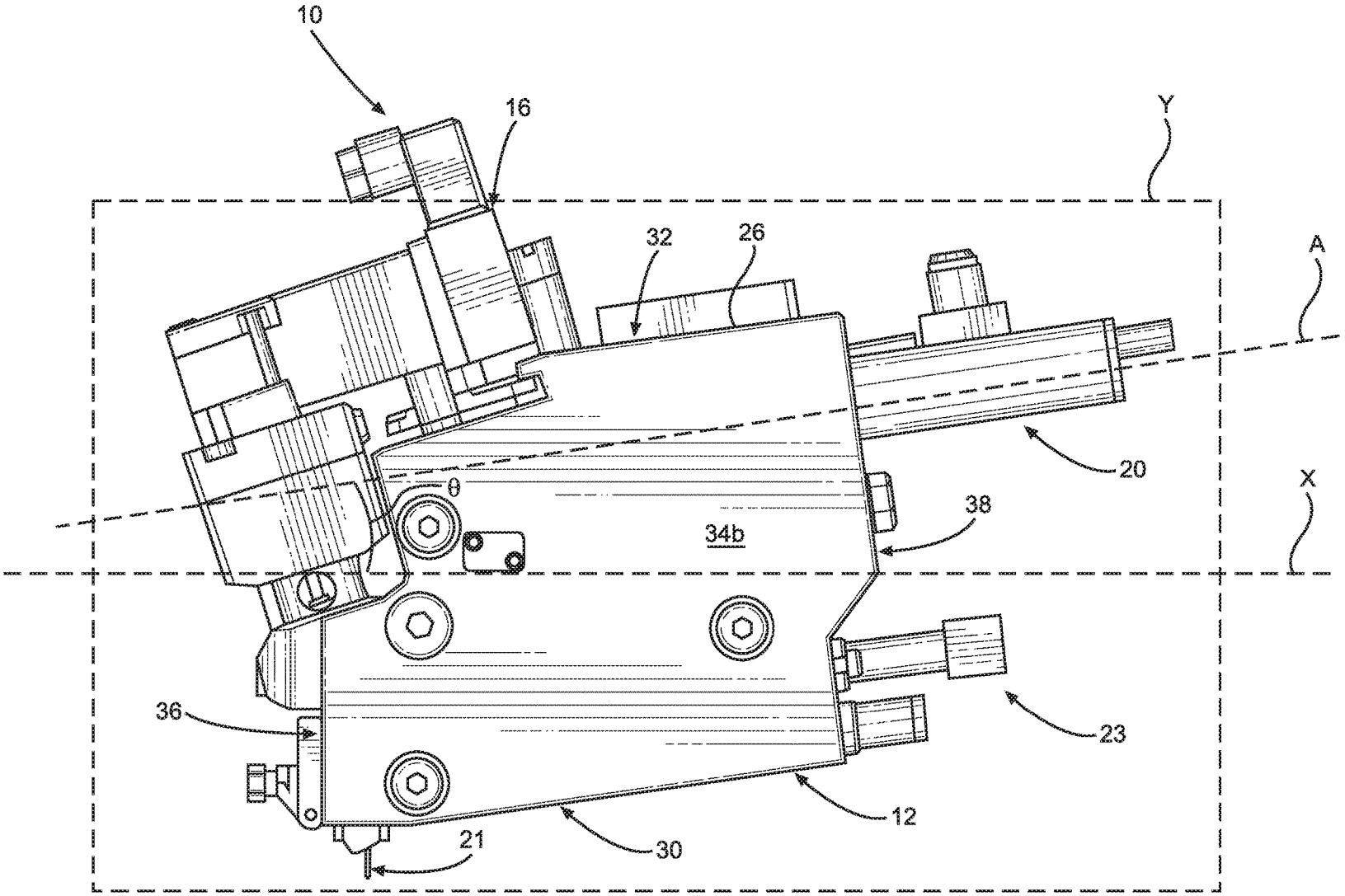
FIG. 4 is a side view of the applicator shown in FIG. 1.

Referring to FIGS. 2-4, the first side surface 34*a* of the manifold 12 lies within a first plane P1, while the second side surface 34*b* lies within a second plane P2. The second plane P2 may be parallel to the first plane P1. However, the first and second planes P1 and P2 may not be parallel if the first and second side surfaces 34*a* and 34*b* are angled with respect to each other. The applicator 10 defines a horizontal plane X, such that the lateral and longitudinal directions 4 and 2 lie within the horizontal plane X. The pump assembly 20 may define a drive shaft axis A that lies within a plane Y. The interrelationship of these planes and axes will be described further below.

The applicator 10 includes an input connector 14, through which adhesive is pumped into the manifold 12. The adhesive can be pumped through a hose 5 from a melter 3 to the input connector 14, where the melter 3 can be configured to receive the adhesive in a solid form and melt the adhesive before providing the adhesive to the applicator 10. The applicator 10 may include a filter 13 (shown in FIG. 16) that filters any remaining solid components from the adhesive after it enters the applicator 10. The manifold 12 may further include a pressure release valve 17 that allows a user to attenuate pressure created by adhesive within the manifold, and a dispensing module 16 for applying the adhesive to a substrate. When the pressure release valve 17 is opened, adhesive may drain from the manifold through a drain (not shown). The applicator 10 also includes a pump assembly 20 removably mounted to the manifold 12. The pump assembly 20 pumps adhesive flowing from an interior channel of the manifold 12 to the dispensing module 16, which then dispenses adhesive out of the applicator through a nozzle 21. The applicator 10 may include thermal elements 23 that are configured to elevate the temperature of the manifold 12, which, in turn, elevates the temperature of the pump 40 in each pump assembly 20. Though FIGS. 1-5 depict the applicator 10 as including five thermal elements 23*a*-23*e*, any number of thermal elements 23 can be included as required.

In various embodiments, the applicator 10 includes multiple sets of pump assemblies 20, dispensing modules 16, and nozzles 21. As illustrated in FIGS. 1-5, for example, the applicator 10 is depicted as including seven pump assemblies 20*a*, 20*b*, 20*c*, 20*d*, 20*e*, 20*f*, and 20*g*. Although FIGS. 1-5 illustrate seven pump assemblies 20*a*-20*g*, the applicator 10 can include any number of pump assemblies 20 as desired. For example, the applicator 10 can include two pump assemblies, three pump assemblies, or more than three pump assemblies. The pump assemblies 20*a*-20*g* may be arranged in a side-by-side configuration to increase the processing width of the applicator 10. For clarity, a single pump assembly 20 is described below. However, reference number 20 can be used interchangeably with reference numbers 20*a*-20*g*. Though the pump assemblies 20*a*-20*g* are depicted as being similarly sized, each of the individual pump assemblies 20 included in the applicator 10 can be individually sized as desired to suit a particular purpose. For example, the recirculation pump assembly 20*g*, which will be described further below, may be larger than the other pump assemblies 20*a*-20*f*.

Additionally, the applicator 10 is depicted as including six dispensing modules 16*a*, 16*b*, 16*c*, 16*d*, 16*e*, and 16*f*. Although FIGS. 1-3 illustrate six dispensing modules 16*a*-16*f*, the applicator can include any number of dispensing modules 16 as desired. For example, the applicator 10 can include one dispensing module, two dispensing modules, or more than two dispensing modules. Similarly, a single dispensing module 16 is described below. However, the reference number 16 can be used interchangeably with reference numbers 16*a*-16*f* The applicator 10 is also depicted as including six nozzles 21*a*, 21*b*, 21*c*, 21*d*, 21*e*, and 21*f*. Each of nozzles 21*a*-21*f* may receive an adhesive feed from a corresponding dispensing module 16, or a combination of several of the dispensing modules 16*a*-16*f*. The configuration of the nozzles 21*a*-21*f* can be changed by a user as operation conditions require, which can include adding additional nozzles 21 or removing any of the nozzles 21*a*-21*f* that are already coupled to the applicator 10. Additionally, the nozzles 21*a*-21*f* can be differently types chosen to suit particular dispensing applications. For example, as shown in FIG. 3, nozzles 21*a*, 21*b*, 21*e*, and 21*f* can be one type of nozzle, while nozzles 21*c* and 21*d* can be a different type of nozzle.

Continuing with FIGS. 1-5, each of pump assemblies 20*a*-20*f* may be associated with a corresponding one of the dispensing modules 16*a*-16*f*. In operation, each of pump assemblies 20*a*-20*f* may pump fluid that is supplied by the manifold 12 to the corresponding one of the dispensing modules 16*a*-16*f*, such that the dispensing modules 16*a*-16*f* apply the adhesive to a given substrate through nozzles 21*a*-21*d*. However, each dispensing module 16 may not correspond to a single pump assembly 20, such that multiple pump assemblies 20 pump adhesive to a single dispensing module 16. Additionally, each of the pump assemblies 20 and each of the dispensing modules 16 may be coupled to and associated with a respective manifold segment 22. However, two or more pump assemblies 20 and/or two or more dispensing modules 16 may be coupled to a single manifold segment 22.

Figure 5:
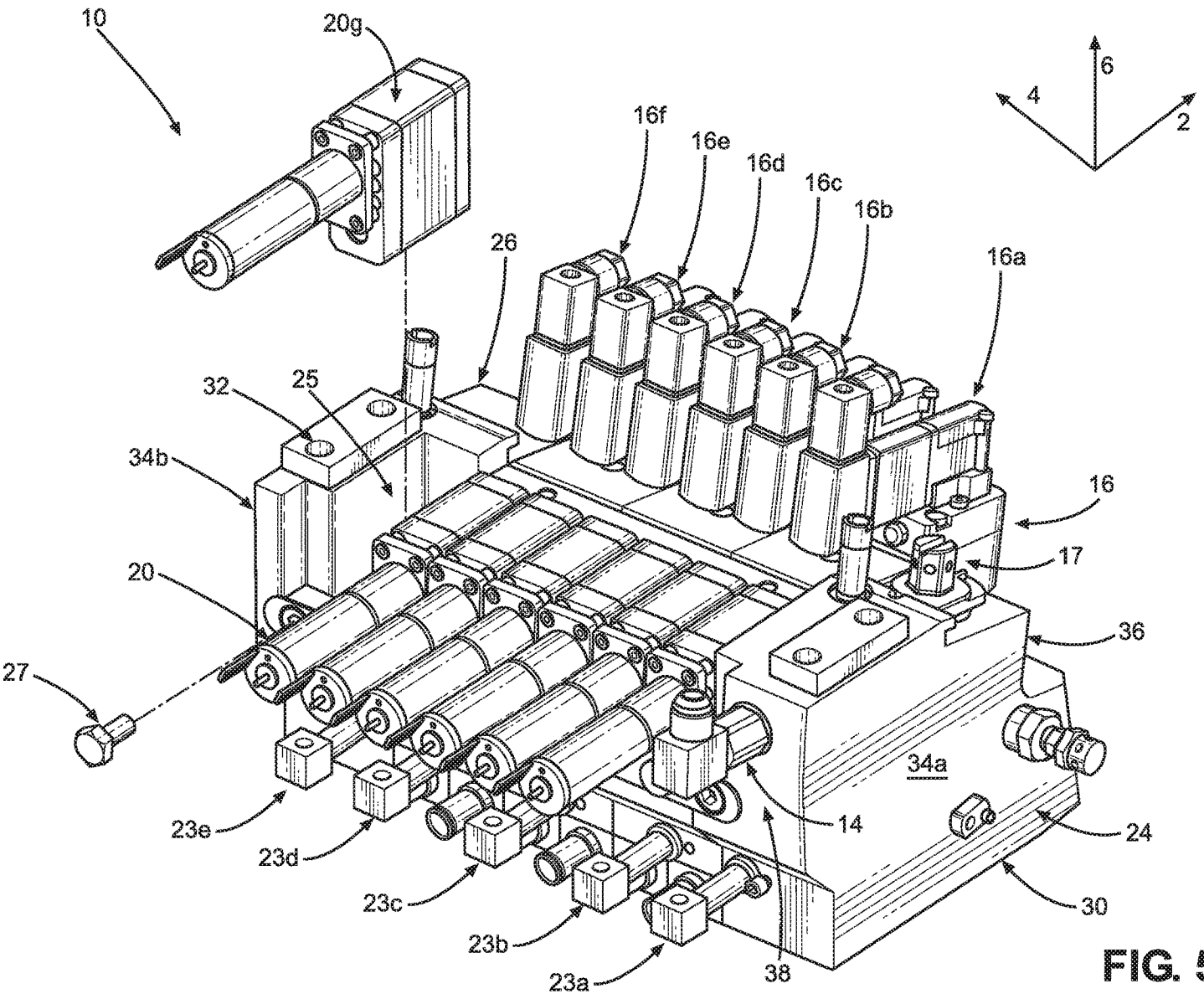
FIG. 5 is a rear perspective view of the applicator shown in FIG. 1, with a recirculation pump assembly removed from the applicator.
Figure 6:
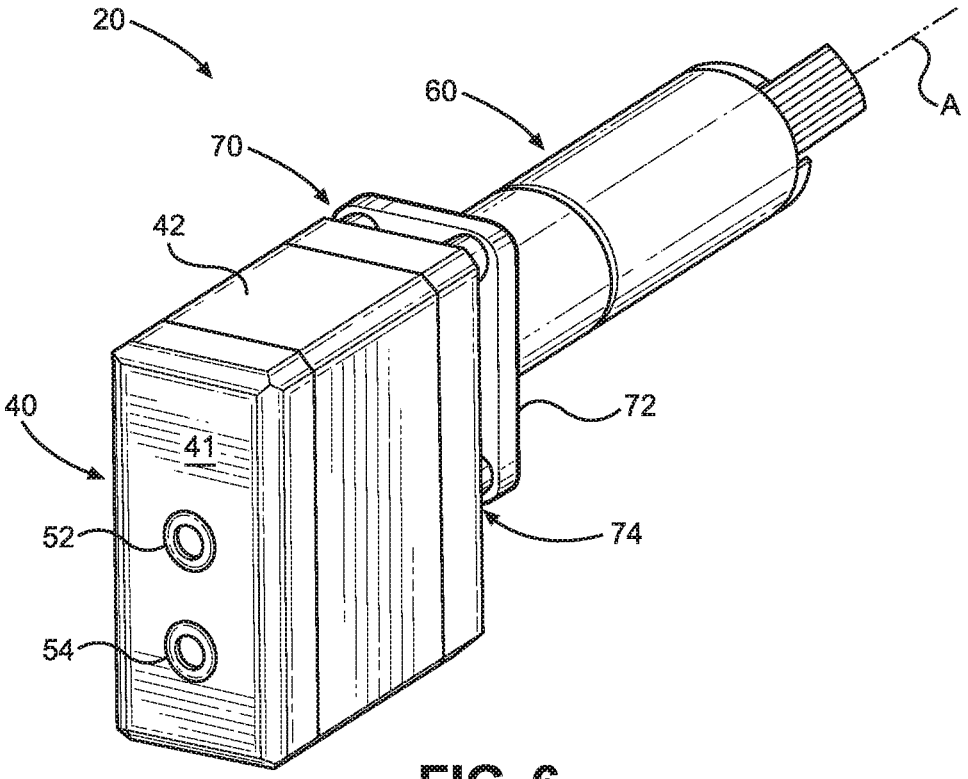
FIG. 6 is a bottom perspective view of a pump assembly used in the applicator shown in FIG. 1.
Figure 7:
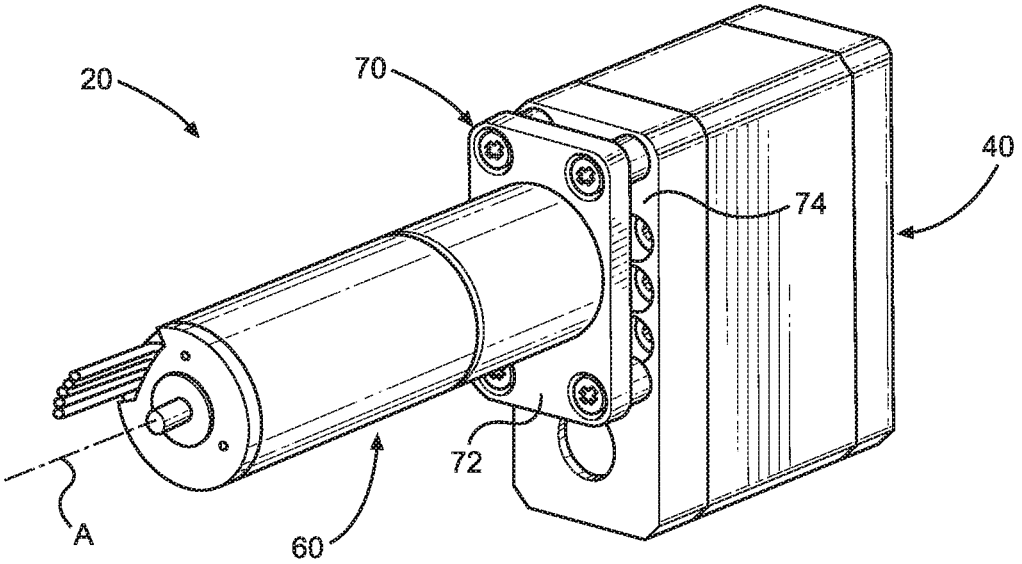
FIG. 7 is a top perspective view of the pump assembly shown in FIG. 6.
Figure 8:
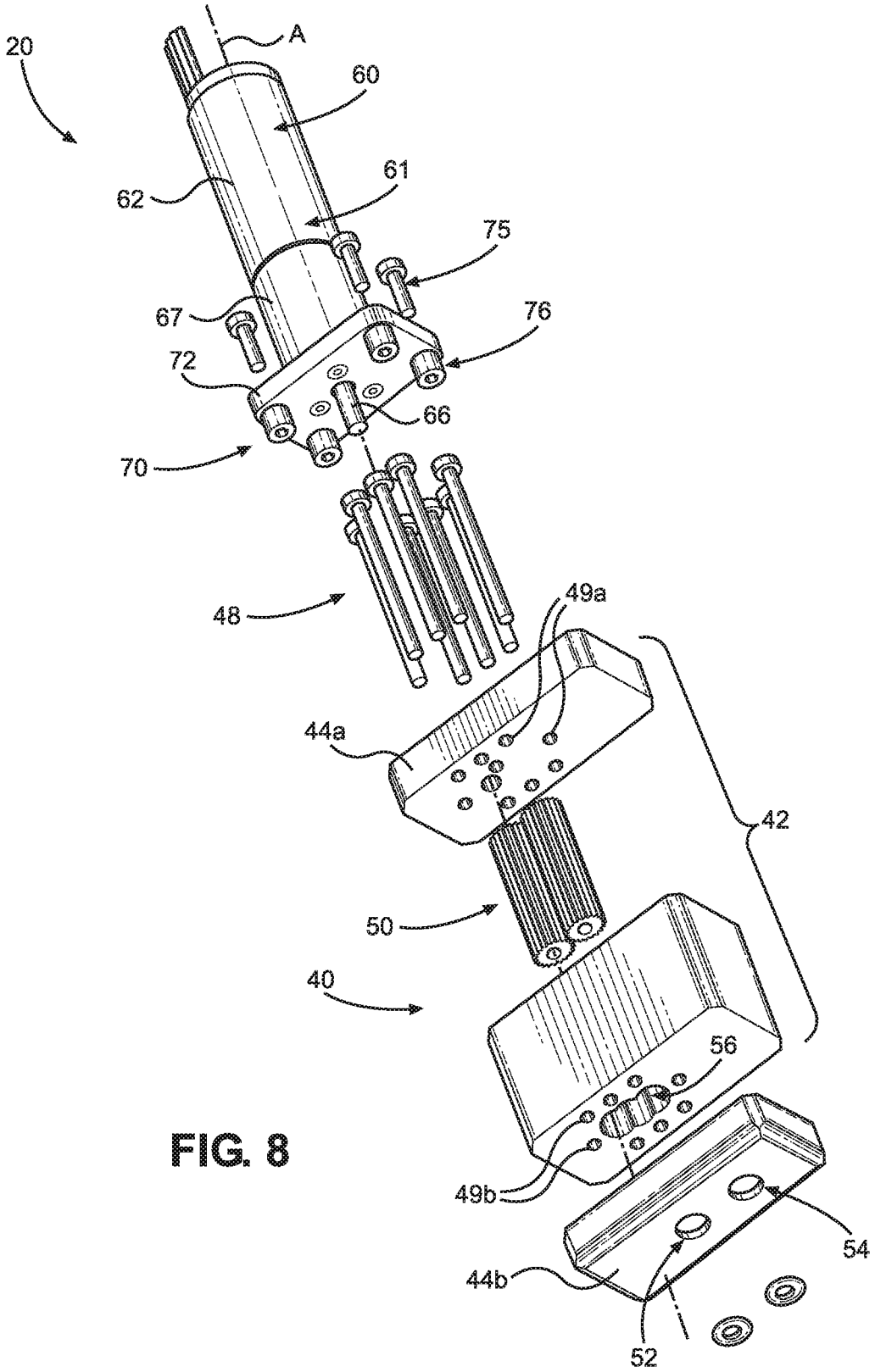
FIG. 8 is an exploded view of the pump assembly shown in FIG. 6.
Figure 9:
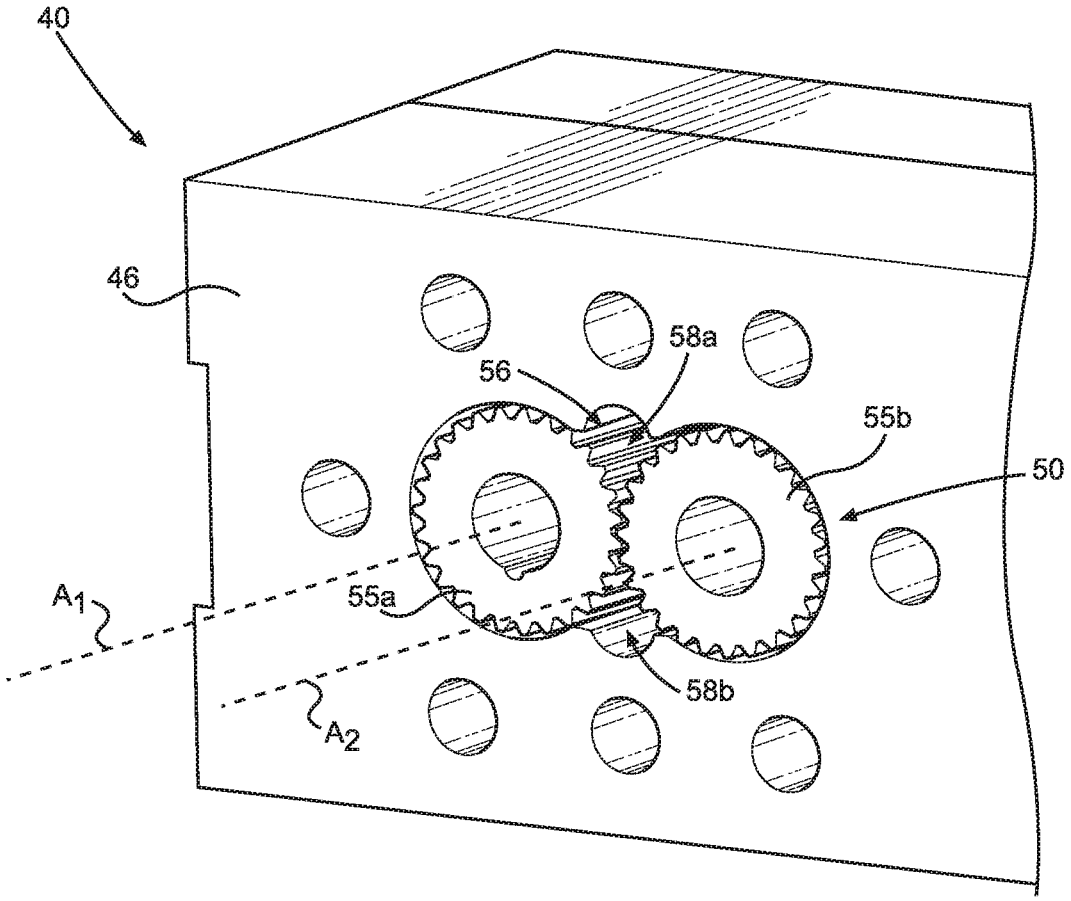
FIG. 9 is a sectional view of the pump assembly shown in FIG. 6.

The pump assembly 20*g*, however, is not associated with a particular dispensing module 16, but is designated as the recirculation pump assembly. The function of the recirculation pump assembly 20*g* may include pumping the adhesive through a recirculation channel 236, as will be described below. As such, the inlet 52 of the pump assembly 20*g* is in fluid communication with the recirculation channel 236, and the outlet of the pump assembly 20*g* is in fluid communication with the supply channel 200. Though the pump assembly 20*g* is shown as the pump assembly 20 positioned closest to the second side surface 34*b*, the recirculation pump assembly 20*g* may be positioned anywhere along the series of pump assemblies 20*a*-20*g*. For example, the recirculation pump assembly 20*g* may be positioned as the pump assembly closest to the first side surface 34*a*, or at a location in the middle of the pump assemblies 20*a*-20*g*. When the pump assembly 20*g* is positioned as the closest pump to the first or second side surface 34*a* or 34*b* of the applicator 10, the particular one of the first or second end plates 24 or 26 that the pump assembly 20*g* abuts may be configured to receive a portion of the pump assembly 20*g*. For example, as shown in FIG. 5, the second end plate 26 includes a recess 25 that is sized to receive a housing assembly 42 of the pump assembly 20*g*. When the pump assembly 20*g* is disposed in the recess 25, the pump assembly 20*g* may be substantially in line with the other pump assemblies 20*a*-20*f* along the longitudinal and transverse directions 2 and 6.

Additionally, though in this embodiment pump assembly 20*g* is configured to be the sole recirculation pump assembly for the applicator 10, it is contemplated that in other embodiments the applicator 10 can include multiple recirculation pump assemblies (not shown), each of which can be similarly configured as pump assembly 20*g*. For example, each dispensing module 16 can correspond to a unique recirculation pump assembly. Alternatively, the applicator 10 can include multiple recirculation pump assemblies that collectively pump adhesive through a single recirculation channel. In another embodiment with multiple recirculation pump assemblies, each recirculation pump assembly can pump adhesive through separate respective recirculation channels. Further, in other embodiments the applicator 10 can include a pump assembly that includes the functionality of both pumping adhesive to a dispensing module 16, as well as pumping adhesive through the recirculation channel. Such a pump assembly may be configured as a single dual-gear stack pump, where one gear stack functions to pump adhesive to a dispensing module 16, while the other functions to pump adhesive through the recirculation channel. Each gear stack can contain one driving gear and one driven gear, and each gear stack can be contained within a common pump body. Alternatively, each gear stack can be contained within separate respective pump bodies. Further, each gear stack can be driven by a common motor, or alternatively be independently driven by separate respective motors.

Referring to FIGS. 6-10, each pump assembly 20*a*-20*g* includes a pump 40 and a dedicated drive motor unit 60 that powers the pump 40. Because each pump 40 has a dedicated drive motor unit 60, each pump assembly 20 can be independently controlled by the operator and/or a control system (not shown). The pump assembly 20 also includes a thermal isolation region 70 positioned between the pump 40 and the drive motor unit 60. Thermal elements 23 may be used to elevate the temperature of the manifold 12, which, in turn, elevates the temperature of the pump 40 in each pump assembly 20. The thermal isolation region 70 minimizes thermal transfer from the pump 40 to the drive motor unit 60, thereby minimizing the effect of temperature on the electronic components in the drive motor unit 60. Exposing the electronic components in the drive motor unit 60 to a sufficiently elevated temperature may damage the electronic components, which may render the drive motor unit 60 inoperable.

The drive motor unit 60 includes a motor 62, an output drive shaft 66, and one or more connectors (not shown) that are coupled to a power source (not shown). The drive motor unit 60 is coupled to a gear assembly 67, which may include any type of gears as desired that transfer rotational motion from an output drive shaft 66 of the motor to the input drive shaft (not shown) of the pump to attain the desired rotational speed. In one embodiment, the gear assembly 67 includes a planetary gear train. The output drive shaft 66 has a drive axis A about which the output drive shaft 66 rotates.

Referring back to FIGS. 3 and 4, the pump assembly 20 may be mounted to the manifold 12 in a number of different configurations. In one embodiment, the pump assembly 20 is mounted to the manifold 12 so that the bottom surface 41 of the pump 40, which includes an inlet 52 and an outlet 54, faces the manifold 12 at a location that is spaced apart from and located between the first and second side surfaces 34*a* and 34*b*. In this configuration, the drive motor axis A does not intersect either the first side surface 34*a* or the second side surface 34*b* of the applicator 10. Rather, the pump assembly 20 is positioned on the manifold 12 such that the drive motor axis A of the drive motor unit 60 may lie in a plane Y that is parallel to the first plane P1, in which the first side surface 34*a* lies, as described above. The plane Y may also be parallel to the second plane P2, in which the second side surface 34*b* lies. Each pump assembly 20*a*-20*g* has a respective axis A that lies within a respective plane that may be parallel to the first plane P1 and/or the second plane P2. Further, when mounted to the manifold 12, the pump assemblies 20*a*-20*f* can be positioned such that the inlets 52 of each of the pump assemblies 20*a*-20*f* are positioned above the outlets 54 along the transverse direction 6. However, the recirculation pump assembly 20*g* can be mounted to the manifold 12 such that the outlet 54 is positioned above the inlet 52 along the transverse direction 6.

Continuing with FIGS. 3 and 4, the pump assembly 20 is positioned on the manifold 12 such that the drive motor axis A is oriented in any particular direction within plane Y. For example, the pump assembly 20 can be positioned on the manifold 12 such that the drive motor axis A lies within plane Y and is angularly offset with respect to plane X. For instance, the pump assembly 20 can be positioned on the manifold 12 such that the drive motor axis A defines an angle θ with plane X. The angle θ can be any angle as desired. In one embodiment, the angle θ is an acute angle. Alternatively, the angle θ can be an obtuse angle, an angle greater than 180 degrees, or substantially 90 degrees.

Referring to FIGS. 6-10, the pump 40 includes a housing assembly 42 and a gear assembly 50 contained within the housing assembly 42. Alternatively, more than one gear assembly 50 may be contained within the housing assembly 42. The housing assembly 42 further includes an inlet 52 that is configured to receive adhesive from the manifold segment 22, as well as an outlet 54 for discharging adhesive back into the manifold segment 22. In accordance with the embodiment illustrated in FIGS. 6-10, the inlet 52 and the outlet 54 of the pump 40 are defined by a bottom surface 41 of the pump 40 and are oriented in a direction that is parallel to the drive motor axis A of the drive motor unit 60.

The housing assembly 42 comprises an upper plate 44*a*, a lower plate 44*b*, and a central block 46. The upper and lower plates 44*a* and 44*b* are spaced from each other along a direction that is aligned with a drive axis A of the drive motor unit 60. The lower plate 44*b* defines a bottom surface 41, through which the drive axis A may extend. The upper plate 44*a*, the central block 46, and the lower plate 44*b* are coupled together with bolts 48. The upper plate 44*a* has a plurality of bores 49*a* that are configured to receive the bolts 48, the central block 46 has a plurality of bores 49*b* that are configured to receive the bolts 48, and the lower plate 44*b* has a plurality of bores 49*c* that are configured to receive the bolts 48. The bolts 48, bores 49*a*, bores 49*b*, and bores 49*c* may be threaded, such that the bores 49*a-c* are capable of threadedly receiving the bolts 48.

Figure 10:
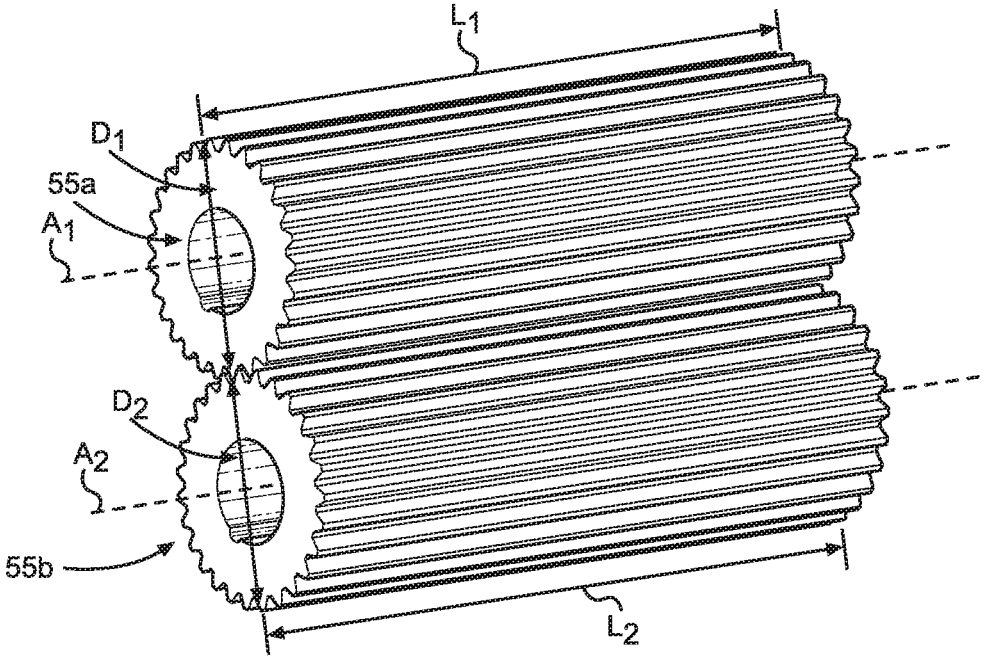
FIG. 10 is a perspective view of a gear assembly used in the pump assembly shown in FIGS. 6-9.

The central block 46 has an internal chamber 56 that is sized to generally conform to the profile of the gear assembly 50. In one embodiment, the gear assembly 50 includes a driven gear 55*a* and an idler gear 55*b*, which are known to a person of ordinary skill in the art. The driven gear 55*a* is coupled to the output drive shaft 66 of the drive motor unit 60 such that rotation of the output drive shaft 66 rotates the driven gear 55*a*, which, in turn, rotates the idler gear 55*b*. The driven gear 55*a* rotates about a first axis $A_1$, while the idler gear 55*b* rotates about a second axis $A_2$. In FIG. 10, the first axis $A_1$ is illustrated as coaxial with the drive motor axis A. However, it is also contemplated that the first axis $A_1$ may be offset from the drive motor axis A. The gear assembly 50 may include an elongate gear shaft (not shown) that is coupled to an end of the output drive shaft 66 via a coupling (not shown). The gear shaft extends into the driven gear 55*a*, and is keyed to actuate the driven gear 55*a*. A seal member (not shown), such as a coating and/or an encasement, can be placed around the elongate gear shaft to facilitate sealing of the gear assembly 50 and internal chamber 56.

In use, rotation of the driven gear 55*a* and the idler gear 55*b* drives adhesive in the pump 40 from a first section 58*a* of the internal chamber 56 to a second section 58*b* of the internal chamber 56. The adhesive is then routed from the second section 58*b* of the internal chamber 56 to the outlet 54. In accordance with the illustrated embodiment, the driven gear 55*a* has a diameter $D_1$ and a length $L_1$, where the length $L_1$ may be greater than the diameter $D_1$. Likewise, the idler gear 55*b* has a diameter $D_2$ and a length $L_2$, where the length $L_2$ may be greater than the diameter $D_2$. While a gear assembly 50 with two gears is shown, the pump can have a gear assembly that has any number of gear configurations to produce the desired flow rate of adhesive through the pump 40. In these configurations, the central block 46 can be segmented to support gear stacking. In one embodiment, a plurality of gear assemblies (not shown) can be stacked along the pump input shaft. In this embodiment, the gear assemblies can have different outputs that are combined into a single output stream. In another embodiment, the gear assemblies have different outputs that can be kept separate to provide multiple outputs through additional porting in the lower plate 44*b* and the manifold 12.

Continuing with FIGS. 6-10, the thermal isolation region 70 is defined by a thermal isolation plate 72 and a gap 74 that extends from the thermal isolation plate 72 to the housing assembly 42. The pump assembly 20 includes bolts 75 that couple the thermal isolation plate 72 to the top of the housing assembly 42 so that the gap 74 is formed between the housing assembly 42 and the thermal isolation plate 72. The thermal isolation plate 72 can include a plurality of spacers 76 that are disposed around the bolts 75 and are positioned between a surface of the thermal isolation plate 72 and the upper plate 44*a* of the housing assembly 42. The spacers 76 may be monolithic with the thermal isolation plate 72, or may be separable from the thermal isolation plate 72 such that the gap 74 may be adjustable. The spacers 76 may extend inward from the upper plate 44*a* to ensure the output drive shaft 66 and the driven gear 55*a* are aligned. The thermal isolation plate 72 functions to inhibit the transfer of heat from the pump 40 to the drive motor unit 60. To do this, the thermal isolation plate 72 and the spacers 76 are made of a material that has a lower thermal conductivity than the adhesives that form the components of the housing assembly 42 and an outer casing 61 of the drive motor unit 60. Furthermore, the spacers 76 separate the thermal isolation plate 72 and the housing assembly 42 such that the thermal isolation plate 72 and the housing assembly 42 has the gap 74, which minimizes direct contact between the housing assembly 42 and the drive motor unit 60.

Referring to FIG. 3, each of the pump assemblies 20*a*-20*g* is removably attached to the manifold 12. In one embodiment, each pump assembly 20 is secured to a plate 28 via a fastener 27. The plate 28 is attached at one end to the first end plate 24 via a fastener 29, and at the opposite end to the second end plate 26 via another fastener 29. The fasteners 29 can also attach the plate 28 to one of the manifold segments 22. Fasteners 27 may be threaded, such that removing a pump assembly 20 from the manifold 12 requires unscrewing fastener 27 from the pump assembly 20 and removing the pump assembly 20 from the manifold 12. However, other methods of releasably attaching the pump assemblies 20 to the manifold 12 are contemplated, such as a slot and groove system, snap fit engagement, etc. Because the pump assemblies 20 may be releasably coupled to the manifold 12 in the above manner, a particular pump assembly 20 may be individually replaced without completely disassembling the entire applicator 10. Pump assemblies 20 may require replacement for a variety of reasons, including cleaning, damage, or changed adhesive pumping conditions or requirements.

Figure 11:
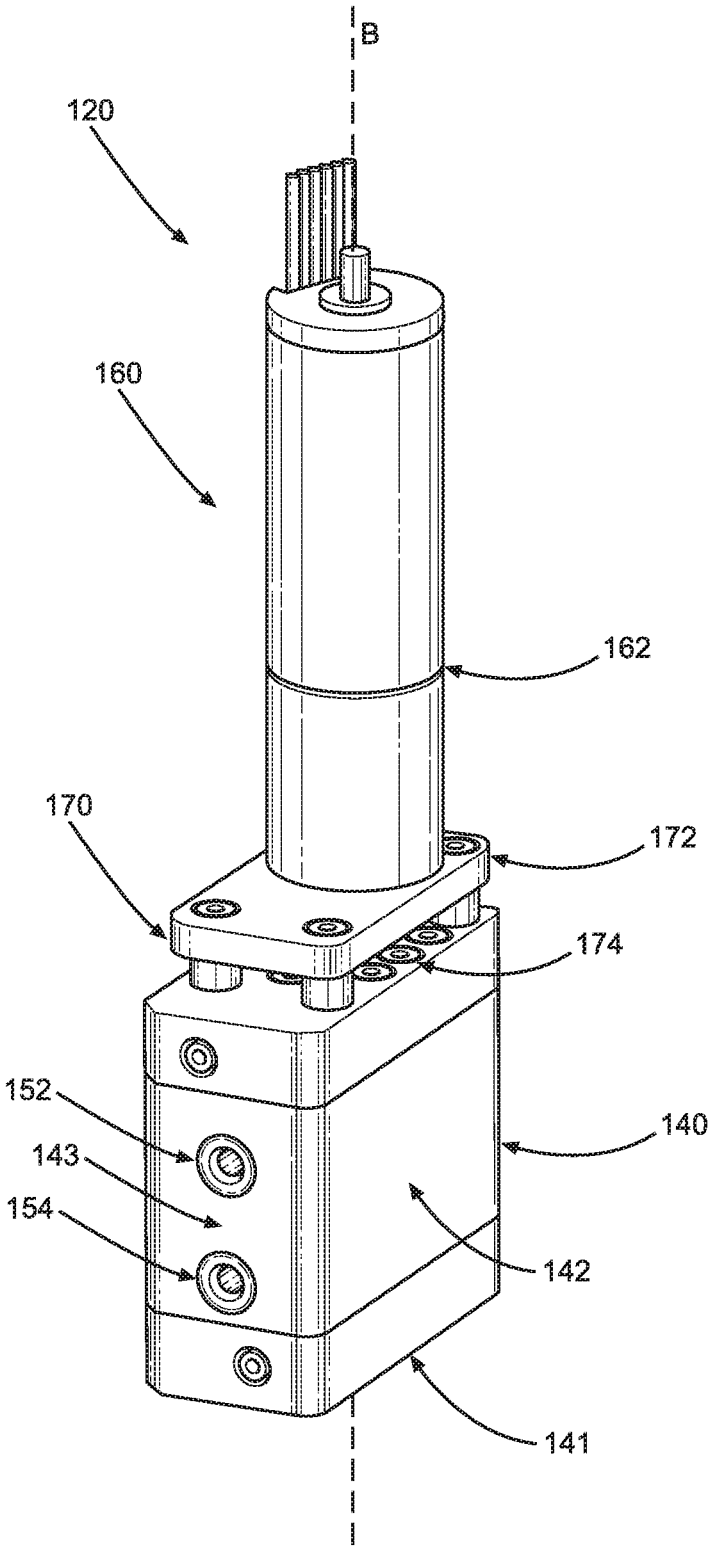
FIG. 11 is a perspective view of an alternative pump assembly that can be used in the applicator shown in FIG. 1.
Figure 12:
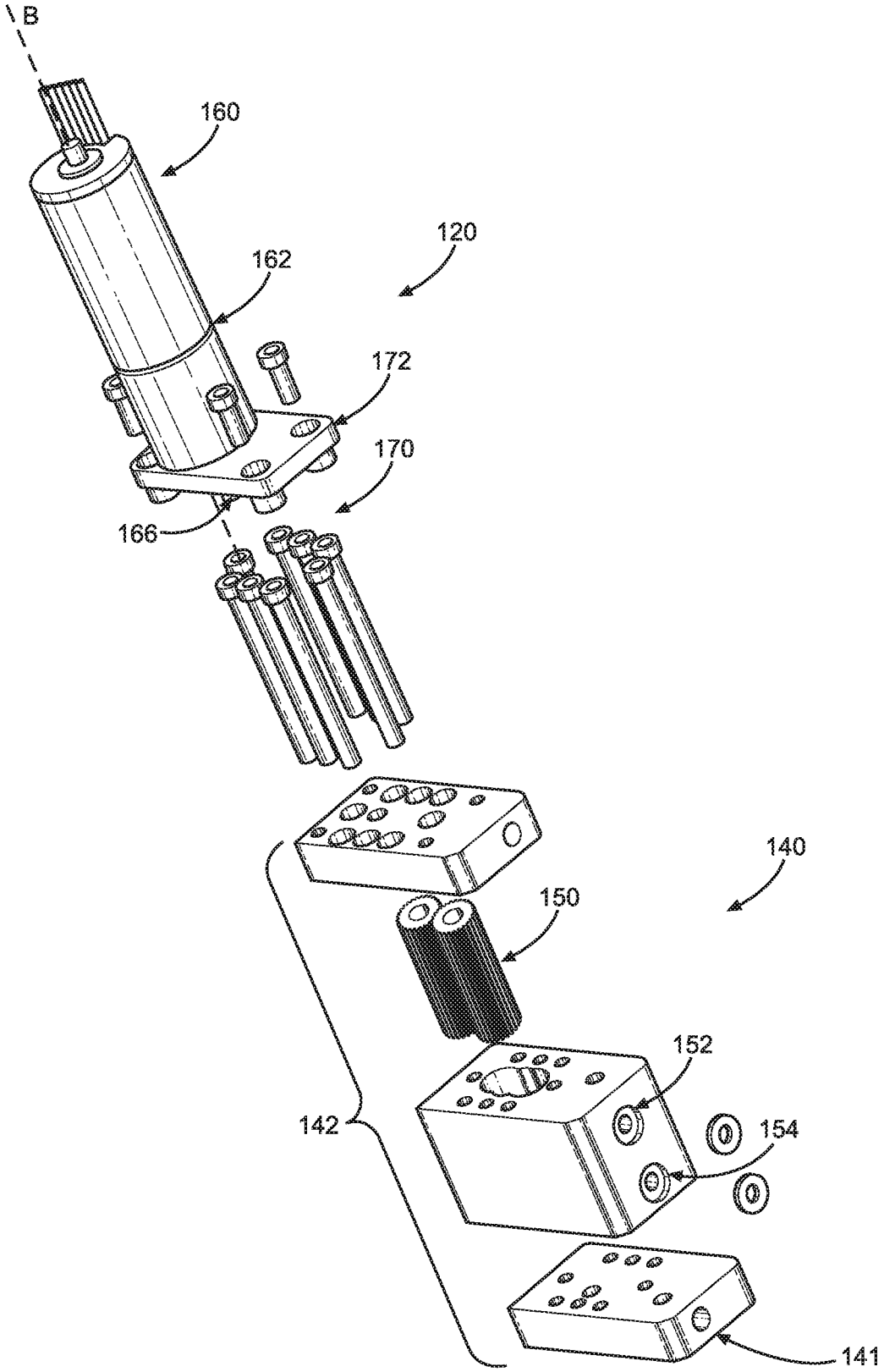
FIG. 12 is an exploded view of the pump assembly shown in FIG. 11.
Figure 13:
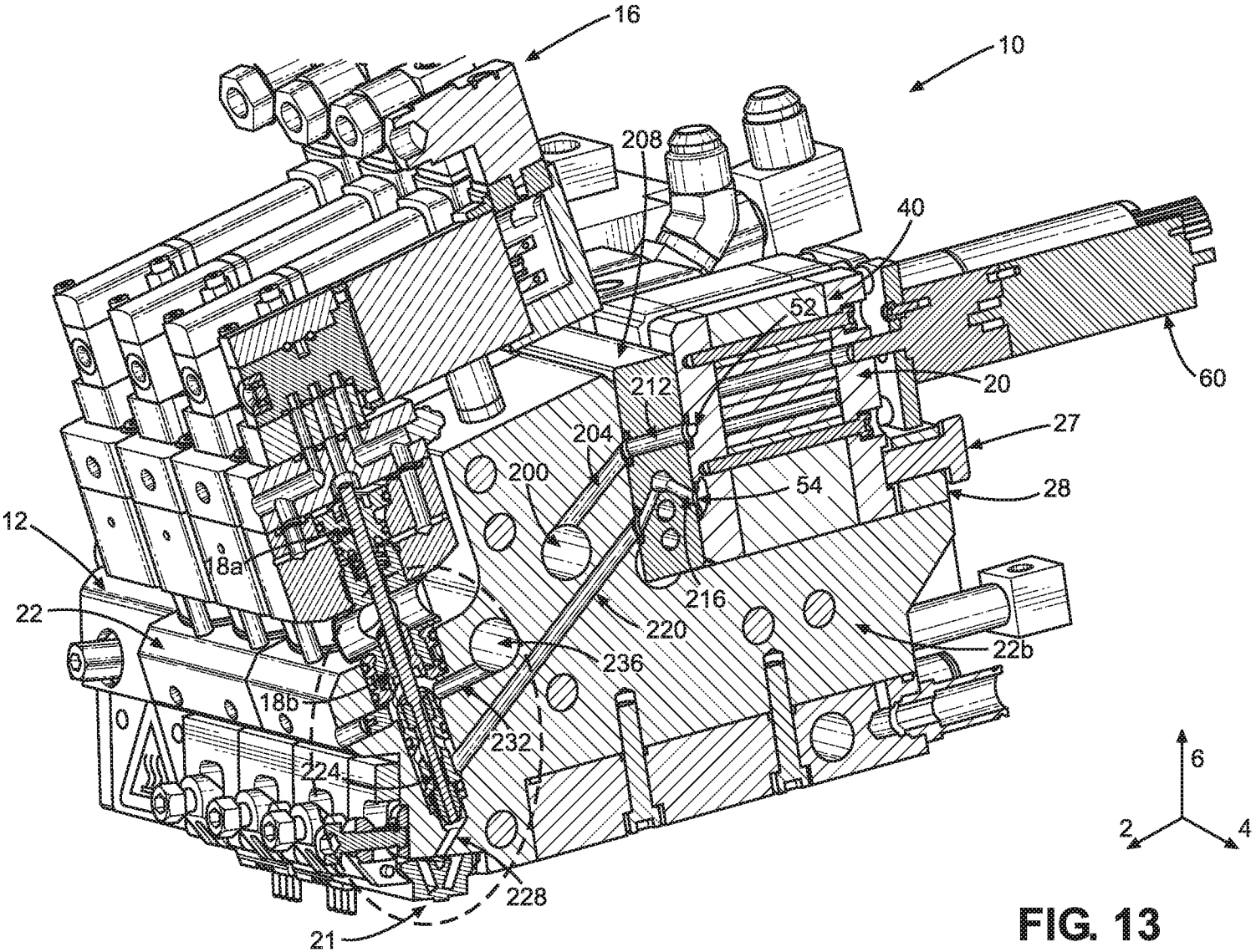
FIG. 13 is a perspective view of the applicator shown in FIG. 1, in horizontal cross-section.

FIGS. 11-12 illustrate another embodiment of the present invention. FIG. 13 shows a pump assembly 120 that is similar in most aspects to the pump assembly 20 shown in FIGS. 1-9 and described above. However, the pump assembly 120 has an inlet 152 and an outlet 154 that are oriented differently than the inlet 52 and outlet 54 of the pump assembly 20. The pump assembly 120 is configured to supply heated liquid to the manifold 12 at a given volumetric flow rate. Each pump assembly 120 includes a pump 140 and a dedicated drive motor unit 160 that powers the pump 140. The pump assembly 120 also includes a thermal isolation region 170 between the pump 140 and the drive motor unit 160. The thermal isolation region 170 is defined by a thermal isolation plate 172 and a gap 174 that extends from the thermal isolation plate 172 to the housing assembly 142. The thermal isolation region 170 minimizes thermal transfer of heat generated by the pump 140 to the drive motor unit 160, thereby minimizing the effect of temperature on the electronic components in the drive motor unit 160. The dedicated drive motor unit 160 and thermal isolation region 170 are the same as the drive motor unit 60 and the thermal isolation region 70 described above and illustrated in FIGS. 6-9.

Continuing with FIGS. 11-12, the drive motor unit 160 includes a motor 162, an output drive shaft 266, and connectors (not shown) that are coupled to a power source (not shown), as well as the control system 110. The drive shaft 166 has a drive axis B about which the drive shaft 166 rotates. When the pump assembly 120 is coupled to the manifold 12, the drive axis B may intersect and may be angularly offset with respect to the plane X that is perpendicular to the plane Y. In this configuration, the drive motor axis B does not intersect either the first side surface 34*a* or the second side surface 34*b* of the manifold 12. Additionally, the drive motor axis B does not intersect the bottom surface 30 of the manifold 12. Rather, the pump assembly 120 is positioned on the manifold 12 so that drive motor axis B of the drive motor unit 160 lies in a plane Y that is parallel to the first plane P1 and/or the second plane P2 of the first side surface 34*a* and the second side surface 34*b*, respectively.

The pump 140 defines a bottom surface 141 and a side surface 143, and includes a housing assembly 142 and one or more gear assemblies 150 contained within the housing assembly 142, an inlet 152 for receiving liquid from the manifold 12, and an outlet 154 for discharging liquid back into the manifold 12. In accordance with the illustrated embodiment, the inlet 152 and the outlet 154 of the pump 140 are disposed on the side surface 143 of the pump 140, such that the inlet 152 and outlet 154 are oriented in a direction that is perpendicular to the drive motor axis B of the drive motor unit 160.

Continuing with FIGS. 13-14, the flow path of adhesive through the applicator 10 will be described. The flow of adhesive through any particular element is represented by solid arrows that appear in the associated figures. The applicator 10 may be attached to a melter 3 by a hose 5, which attaches to the input connector 14 (as shown in FIG. 1). The adhesive flows from the melter 3, through the hose 5, through the input connector 14, and into the supply channel 200 defined by the manifold 12 of the applicator 10. The supply channel 200 may extend from the first side surface 34*a*, through each of the manifold segments 22*a*-22*c*, and to the second side surface 34*b*. However, the supply channel 200 may not necessarily extend entirely from the first side surface 34*a* to the second side surface 34*b*, but may terminate at an interior location between the first and second side surfaces 34*a* and 34*b*. Additionally, the supply channel 200 may extend between other combinations of surfaces of the manifold 12 as desired.

The manifold 12 includes a pressure release valve 17 that regulates flow in a pressure release channel (not shown) that is in fluid communication with the supply channel 200. The pressure release valve 17 is depicted as being positioned at the front surface 36 of the manifold 12. However, the pressure release valve can be positioned on any surface of the manifold 12 as desired. The pressure release valve 17 is capable of being alternated between an open and closed position. When an operator desires to relieve adhesive pressure within the supply channel 200, the pressure release valve 17 is switched from the closed to open positions. In the open position, adhesive flows from the supply channel 200, through the pressure release channel, and out of the applicator 10 through a drain (not shown). Pressure relief may be desired when the operator is about to commence a service or maintenance operation of the applicator 10.

As the supply channel 200 extends through the manifold 12, it supplies adhesive to each of the pump assemblies 20*a*-22*f*, with the exception of the designated recirculation pump assembly 20*g*. For simplicity, a cross-section of the applicator 10 shown in FIGS. 13-14 only shows the supply of adhesive to one pump assembly 20 and one dispensing module 16. However, the supply channel 200 may supply each additional pump assembly 20 and dispensing module 16 similarly. The manifold segment 22 defines a first segment input channel 204, which extends from the supply channel 200 to a diverter plate 208, which may be positioned on the applicator 10 between the pump assembly 20*d* and the manifold segment 22*b*. The diverter plate 208 may be removably coupled to the applicator 10, and may define a variety of passages for carrying adhesive from the manifold 12, to the pump assemblies 20, and back. For example, as shown in FIG. 13, the diverter plate 208 defines a diverter input channel 212 that extends from the first segment input channel 204 to the inlet 52 of the pump assembly 20*d*. The diverter plate 208 may also define a diverter output channel 216 that extends from the outlet 54 of the pump assembly 20*d* to a second segment input channel 220. However, the diverter plate 208 may include different channel configurations than those shown. The diverter plate 208 shown in FIG. 13 may function as one of many interchangeable diverter plates that may be used to variably route the adhesive through the applicator 10 as different dispensing operations require.

Figure 14:
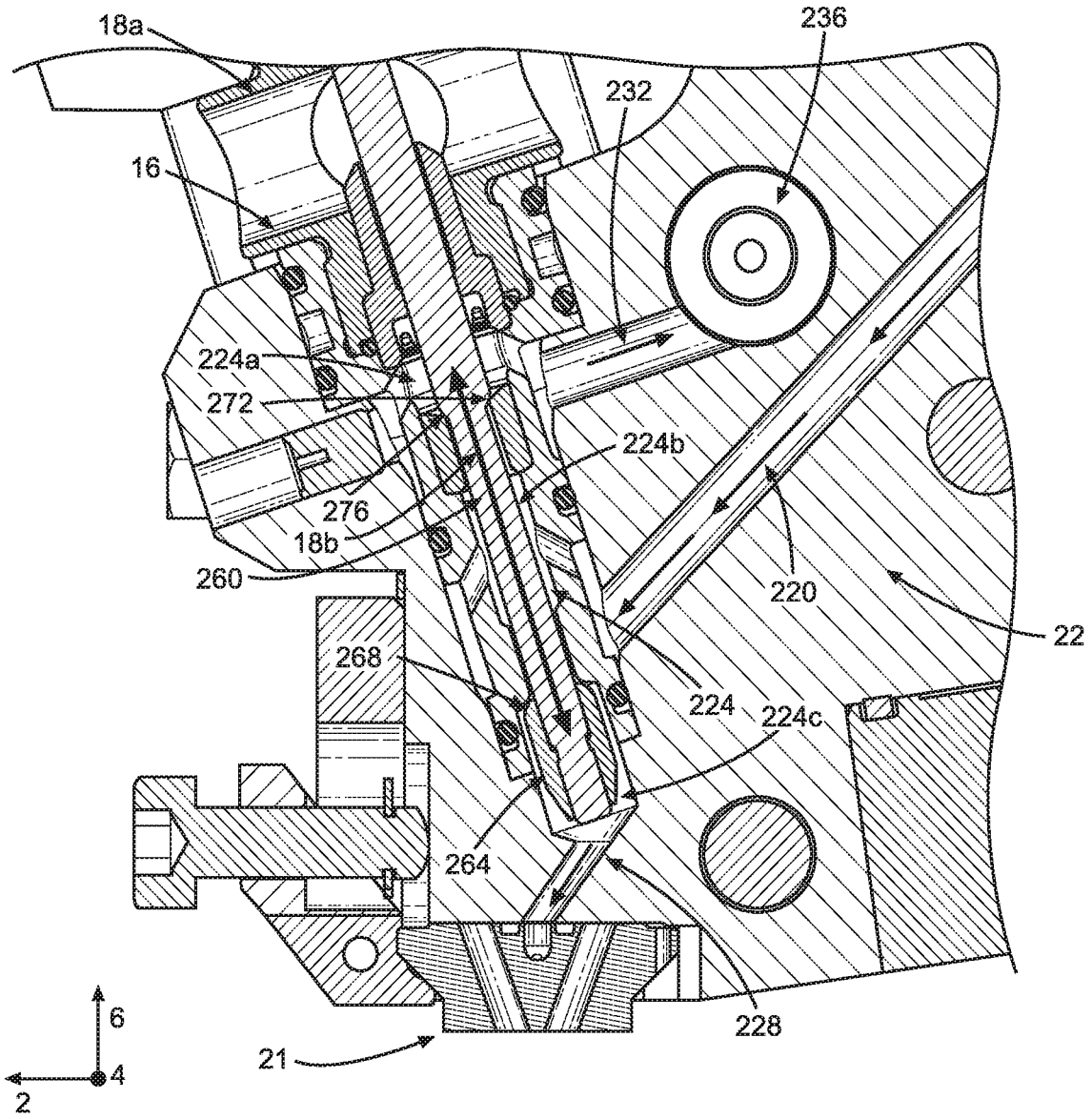
FIG. 14 is an enhanced view of the encircled region shown in FIG. 13.

In the embodiment shown in FIGS. 13-14, the adhesive flows from the supply channel 200, through the first segment input channel 204, through the diverter input channel 212, and to the inlet 52 of the pump assembly 20. The pump assembly 20 then pumps the adhesive out of the outlet 54 at a predetermined volumetric flow rate, which may be different than the volumetric flow rate of the adhesive upon entering the inlet 52 of the pump assembly 20. From there, the adhesive flows through the diverter output channel 216, through the second segment input channel 220, and to a dispensing flow path 224. The dispensing flow path 224 is defined by the lower portion 18*b* of the dispensing module 16, which is received by the manifold segment 22. The dispensing flow path 224 defines an upper section 224*a*, a lower section 224*c* opposite the upper section 224*a*, and a central section 224*b* disposed between the upper and lower sections 224*a* and 224*c*. The lower section 224*c* of the dispensing flow path 224 is in fluid communication with a nozzle channel 228, which extends away from the dispensing flow path 224. The upper section 224*a* of the dispensing flow path 224 is in fluid communication with a recirculation feed channel 232, which extends from the upper section 224*a* of the dispensing flow path 224 to a recirculation channel 236. The recirculation channel 236 will be discussed further below.

The lower portion 18*b* of the dispensing module 16 is the portion of the applicator 10 that directly interacts with the adhesive to control flow of the adhesive out of the applicator 10. The applicator 10 may include a valve stem 260 that extends from an upper portion 18*a* of the dispensing module 16 that is opposite the lower portion 18*b* of the dispensing module 16, to the lower portion 18*b* of the dispensing module 16. The valve stem 260 may define a lower valve element 264 and an upper valve element 272 that is spaced from the lower valve element 264 along the valve stem 260. The lower portion 18*b* of the dispensing module 16 may define a lower valve seat 268 that is configured to interact with the lower valve element 264 of the valve stem 260, and an upper valve seat 276 that is spaced from the lower valve seat 268, where the upper valve seat 276 is configured to interact with the upper valve element 272 of the valve stem 260.

In operation, the valve stem 260 may alternate between a first position and a second position. When the valve stem 260 is in the first position, the dispensing module 16 is in an open configuration. When the valve stem 260 is in the second position, the dispensing module 16 is in a closed configuration. The upper and lower valve elements 272 and 264 may substantially face in opposite directions, such that each of the upper and lower valve elements 272 and 264 interact with the corresponding upper and lower valve seats 276 and 268 in different ones of the first position and second position. In FIGS. 13-14, the upper valve element 272 is shown as facing away from the upper portion 18*a* of the dispensing module 16, while lower valve element 264 is shown as facing toward the upper portion 18*a* of the dispensing module 16. However, in another embodiment this relationship may be reversed, such that the upper valve element 272 faces toward the upper portion 18*a* of the dispensing module 16, while the lower valve elements 264 faces away from the upper portion 18*a* of the dispensing module 16. In one embodiment, in the first position, the valve stem 260 is lowered within the dispensing flow path 224, such that the upper valve element 272 of the valve stem 260 engages the upper valve seat 276, and the lower valve element 264 is spaced from the lower valve seat 268. In this position, the engagement between the upper valve element 272 and the upper valve seat 276 blocks adhesive from flowing from the central section 224*b* of the dispensing flow path 224 to the upper section 224*a*. Rather, the lack of engagement between the lower valve element 264 and the lower valve seat 268 permits adhesive to flow from the central section 224*b* of the dispensing flow path 224 to the lower section 224*c*. As such, when the valve stem 260 is in the first position, adhesive flows from the second segment input channel 220, through the central and lower sections 224*b* and 224*c* of the dispensing flow path 224, and to the nozzle channel 228. From the nozzle channel 228, the adhesive then flows through the nozzle 21 and out of the applicator 10. Accordingly, the first position of this embodiment is the position in which the applicator 10 applies adhesive to a substrate during a manufacturing operation.

In the second position, the valve stem 260 is raised within the dispensing flow path 224, such that the upper valve element 272 of the valve stem 260 is spaced from the upper valve seat 276, and the lower valve element 264 engages the lower valve seat 268. In this position, the engagement between the lower valve element 264 and the lower valve seat 268 blocks adhesive from flowing from the central section 224*b* of the dispensing flow path 224 to the lower section 224*c*. Rather, the lack of engagement between the upper valve element 272 and the upper valve seat 276 permits adhesive to flow from the central section 224*b* of the dispensing flow path 224 to the upper section 224*a*. As such, in the second position, adhesive flows from the second segment input channel 220, through the central and upper sections 224*b* and 224*a* of the dispensing flow path 224, and to the recirculation feed channel 232. From the recirculation feed channel 232, the adhesive flows into the recirculation channel 236. Though one dispensing module 16 and manifold segment 22 is shown in cross section in FIGS. 13-14, each additional dispensing module 16 and manifold segments 22 may be similarly configured. Further, the valve stem 260 of each dispensing module 16 may be configured to be actuated between the first and second positions independent of any of the other valve stems 260, such that at any time the valve stems 260 of the dispensing modules 16 may be in any combination of the first and second positions. Alternatively, any combination of the valve stems 260 may be configured to transition between the first and second positions in unison.

The ability to alternate the valve stem 260 between the particular first and second positions described above serves several purposes. One purpose is that, during an adhesive dispensing operation, a consistent flow of adhesive may not be required or desired. As such, an operator of the applicator 10 must be able to selectively actuate the dispensing modules 16 to both provide and prevent a flow of adhesive to the substrate. Transitioning the valve stem 260 from the first position to the second position blocks adhesive from exiting the applicator 10, while transitioning the valve stem 260 from the second position to the first position allows adhesive to exit the applicator 10. Another purpose of the alternative valve stem 260 described above relates to the pressure within the flow path of the adhesive. When the valve stem 260 is in the first position, the adhesive is permitted to flow through the gap between the lower valve element 264 and the lower valve seat 268, and exit the applicator 10 through the nozzle 21. However, when the valve stem 260 is in the second position, the adhesive cannot flow through this gap. As such, the potential exists for unused adhesive to back up within the dispensing flow path 224 and/or the second segment input channel 220. This back-up can cause pressure to build up within the applicator 10. This pressure, upon the next transition of the valve stem 260 from the second position to the first position, can cause a pattern deformation, such as hammerhead, of the adhesive on the substrate.

The inclusion of the recirculation channel 236 in the applicator 10 helps alleviate this issue. When the valve stem 260 is in the second position, the ability of the adhesive to flow from the central section 224*b* of the dispensing flow path 224 to the upper section 224*a*, and through the recirculation feed channel 232 to the recirculation channel 236 provides the adhesive the ability to escape the dispensing flow path 224. This may alleviate any pressure build-up that could occur when the valve stem 260 is in the second position, thus aiding in standardizing the flow of adhesive through the nozzle 21 (such as through preventing adhesive hammerhead on the substrate) when the valve stem 260 is in the first position. However, the addition of the recirculation channel 236 alone may not fully rectify this issue. Adhesive flowing through recirculation channel 236 inherently creates some amount of pressure within the recirculation channel 236. In a configuration where the recirculation channel 236 directs the adhesive back to the inlet 52 of the pump assembly 20, or to supply tank that supplies the adhesive to the applicator 10, a differential may exist between the pressure of the adhesive flowing through the recirculation channel 236 and the adhesive flowing to the dispensing modules 16*a*-16*f* when the valve stem 260 is in the second position. This pressure differential may cause the flow rate of the adhesive flowing through the nozzle 21 to be inconsistent, as the volume of material entering the recirculation channel 236 may vary over time, depending upon which of the dispensing modules 16*a*-16*f* have valve stems 260 in the second position at a particular moment.

Figure 15:
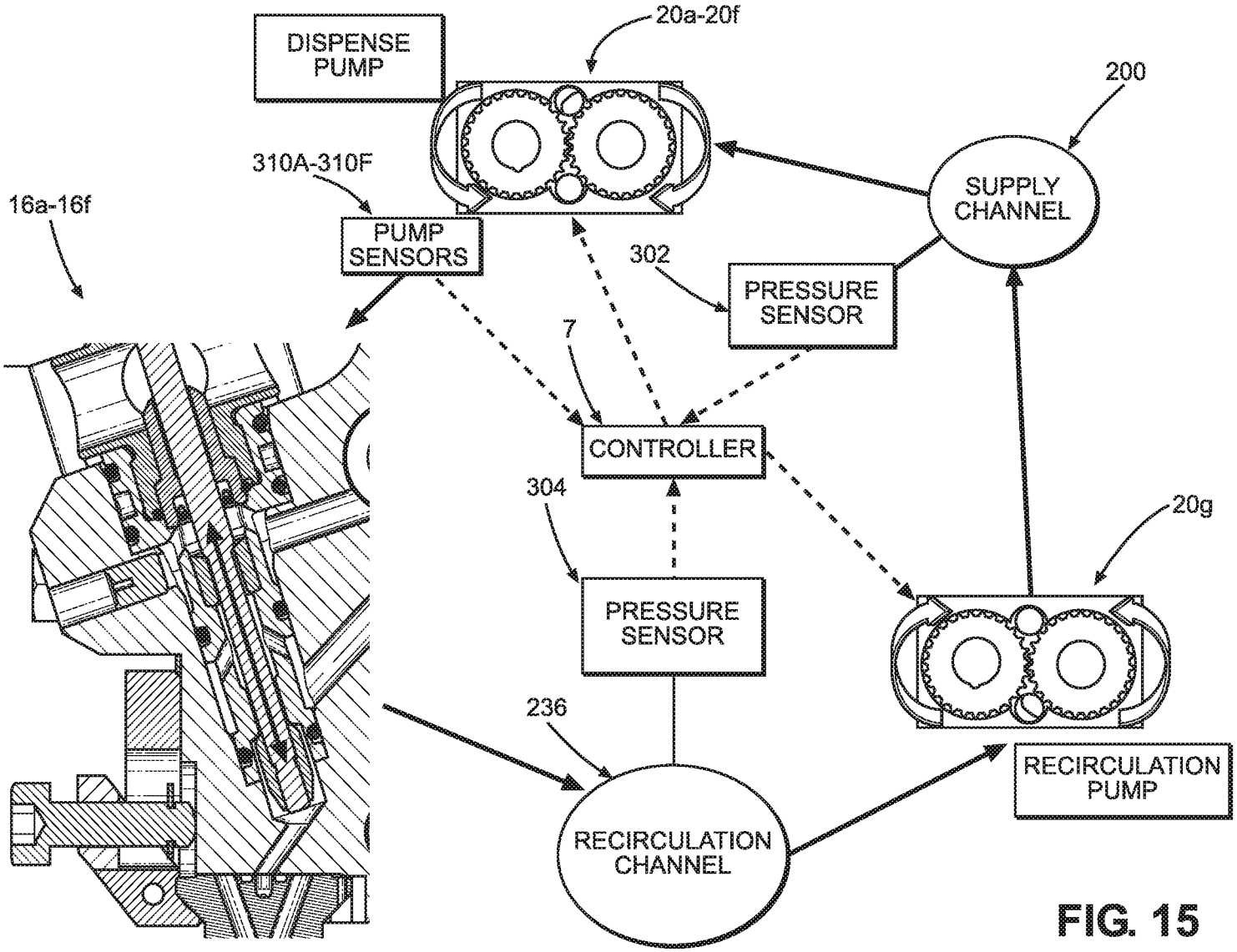
FIG. 15 is a schematic diagram illustrating a method of adhesive recirculation according to an embodiment of the present disclosure.

FIG. 15 illustrates a process flow diagram depicting a system for managing the flow of adhesive through the recirculation channel 236 so as to actively control this pressure differential. Solid lines and arrows indicate the flow of adhesive through the applicator 10, and dashed lines and arrows indicate the transfer of information. The adhesive flows from an adhesive supply (not shown), through a hose (not shown) that is coupled to the input connector 14 (FIG. 1) of the applicator 10, and into the supply channel 200. As the adhesive flows through the supply channel 200, it flows at a first pressure. To detect the first pressure, a first pressure sensor 302 may be disposed within the supply channel 200. The first pressure sensor 302 may be any type of pressure sensor that is capable of measuring the pressure of a fluid, such as, for example, a pressure transducer. The first pressure sensor 302 may measure the first pressure of the adhesive as it flows through the supply channel 200 to the pump assembly 20. The adhesive then flows through dispensing pumps 20*a*-20*f*, which subsequently pump the adhesive to the dispensing modules 16*a*-16*f*. The applicator 10 can include a plurality of pressure sensors 310*a*-310*f*, where each pressure sensor 310*a*-310*f* can be incorporated into or in communication with the output of a respective one of the pump assemblies 20*a*-20*f*. For example, the pressure sensor 310*a* can be in communication with the output of the pump assembly 20*a*, the pressure sensor 310*b* can be in communication with the output of the pump assembly 20*b*, etc. Though any number of pressure sensors 310*a*-310*f* is contemplated, the number of pressure sensors 310*a*-310*f* can generally correspond to the number of pump assemblies 20*a*-20*f*. In one embodiment, the pressure sensors 310*a*-310*f* can be pressure sensors configured to detect the pressure of the adhesive pumped by a corresponding one of the pump assemblies 20*a*-20*f* to the corresponding one of the dispensing modules 16*a*-16*f*. The pressure sensors 310*a*-310*f* can be pressure transducers or any other type of pressure sensor capable of measuring the pressure of fluid.

When the valve stems 260 of the dispensing modules 16*a*-16*f* are in the first position, the adhesive flows out of the nozzles 21. Alternatively, when the valve stems 260 are in the second position, the adhesive flows into recirculation channel 236. The adhesive from each of the dispensing modules 16*a*-16*f* that flows into the recirculation channel 236 is directed to the recirculation pump assembly 20*g*. As the adhesive flows through the recirculation channel 236, it flows at a second pressure. To detect the second pressure, a second pressure sensor 304 may be disposed within the recirculation channel 236. The second pressure sensor 304, like the first pressure sensor 302, may be any type of pressure sensor that is capable of measuring the pressure of a fluid, such as a pressure transducer.

Upon measuring the first and second pressures, the first and second pressure sensors 302 and 304 transmit the first and second pressures to a controller 7. Further, each of the pressure sensors 310*a*-310*f* can be in signal communication with the controller 7 and transmit the detected pressure of the adhesive pumped from the pump assemblies 20*a*-20*f* to the controller 7. The controller 7 may be connected to the applicator 10 through a signal connection 8, which may comprise a wired and/or wireless connection. The controller 7 may include one or more processors, one or more memories, input/output components, and a human-machine interface (HMI) device 7*a*, and may comprise any device capable of including those components. The HMI interface 7*a* may include a touchscreen, mouse, keyboard, buttons, dials, etc. The input/output components may be configured to receive signals containing the first and second pressures from the first and second pressure sensors 302 and 304 via the signal connection 8. The controller 7, using the pressure information received from the first and second pressure sensors 302 and 304 and the pressure sensors 310*a*-310*f*, may actively direct the operation of the recirculation pump assembly 20*g*. Accordingly, the pump assembly 20*g* is operable independent of the other pump assemblies 20*a*-20*f*.

The recirculation pump assembly 20*g* functions to pump adhesive from the recirculation channel 236 back to the supply channel 200. In controlling the recirculation pump assembly 20*g*, the controller 7 actively controls the flow rate at which the recirculation pump assembly 20*g* pumps the adhesive through the recirculation channel 236 by automatically adjusting the speed (RPM) of the drive motor. As a result, the controller 7 can direct the recirculation pump assembly 20*g* to pump the adhesive at a flow rate sufficient to control the pressure differential between the recirculation channel 236 and the pressure at which the pump assemblies 20*a*-20*f* pump the adhesive to the respective dispensing modules 16*a*-16*f* as detected by each of the respective pressure sensors 310*a*-310*f*. In one embodiment, the recirculation pump assembly 20*g* can substantially equalize the second pressure of the adhesive flowing through the recirculation channel 236 with the pressure at which the pump assemblies 20*a*-20*f* pump the adhesive to the respective dispensing modules 16*a*-16*f* as detected by each of the respective pressure sensors 310*a*-310*f*. While the recirculation channel 236 itself reduces pressure differential between material recirculated from the dispensing modules 16*a*-16*f* and material entering the dispensing modules 16*a*-16*f*, the recirculation pump assembly 20*g* functions to actively control the differential between the pressure of adhesive flowing through the recirculation channel 236 and pressure of adhesive flowing to the dispensing modules 16*a*-16*f*, which can aid in increasing continuity in the volumetric output of the adhesive that is applied to a substrate via nozzles 21. Though the controller 7 may be capable of autonomously controlling operation of the recirculation pump assembly 20*g* to equalize these pressures, an operator of the applicator 10 may optionally be able to manually control operation of the recirculation pump assembly 20*g* through the user inputs received by the controller 7, or by running a program stored in the memory of the controller 7. Further, in addition to pressure equalization, in certain embodiments it can be desirable to utilize the recirculation pump assembly 20*g* to create a nonequal relationship between the pressure within the recirculation channel 236 and the adhesive provided to the respective dispensing modules 16*a*-16*f* so as to ensure optimal pattern and flow conditions for particular adhesives or substrates.

Though shown in FIGS. 1-5 as being mounted to the manifold 12, the recirculation pump assembly 20*g* may be spaced from the manifold 12. In this configuration, the recirculation pump assembly 20*g* is connected to the manifold 12 via one or more hoses, allowing the pump assembly 20*g* to receive adhesive from and pump adhesive to the manifold 12. For example, one hose may direct adhesive from the recirculation channel 236 to the recirculation pump assembly 20*g*, while a second hose may direct adhesive from the recirculation pump assembly 20*g* to the supply channel 200.

The presence of the dedicated recirculation pump assembly 20*g* to actively regulate pressure of adhesive flowing through the recirculation channel 236 of the applicator 10 may simplify the overall construction of the applicator 10. For example, with the recirculation pump assembly 20*g*, a second hose that connects the recirculation channel 236 to the adhesive supply (not shown) is not required. Additionally, the applicator 10 becomes better adapted to accommodating different applications. As a client's requirements change, the recirculation pump assembly 20*g* adapts to likewise actively regulate the pressure within the applicator 10, such that the pressure differential between the recirculation channel 236 and the adhesive pumped to the dispensing modules 16*a*-16*f* remains minimal or nonexistent, regardless of application.

The presence of the recirculation pump assembly 20*g* further aids in maintaining tighter tolerances in the flow rate of adhesive exiting the applicator 10 through nozzles 21. Despite the intermittent operation of the dispensing modules 16, actively regulating the pressure of the adhesive in the recirculation channel 236 allows for a controllable and consistent flow rate of adhesive exiting the applicator 10, as opposed to the flow rate being simply a function of the pressure of adhesive in the recirculation channel 236 and adhesive pumped to the dispensing modules 16*a*-16*f* at any given time. This consistent flow rate helps reduce costs incurred during a dispensing operation, particularly in the substrates to which the adhesive is applied. Though some substrates may be more accommodating of the effects of pattern deformations of the adhesive applied to the substrate, some substrates are more sensitive to such variations in adhesive flow. These differences in flow rates can result in substrate deformation or "burn through." By actively regulating the adhesive pressure using recirculation pump assembly 20*g* to ensure a consistent flow rate, wasted substrate can be avoided, thus reducing costs for the operator of the applicator 10.

Figure 16:
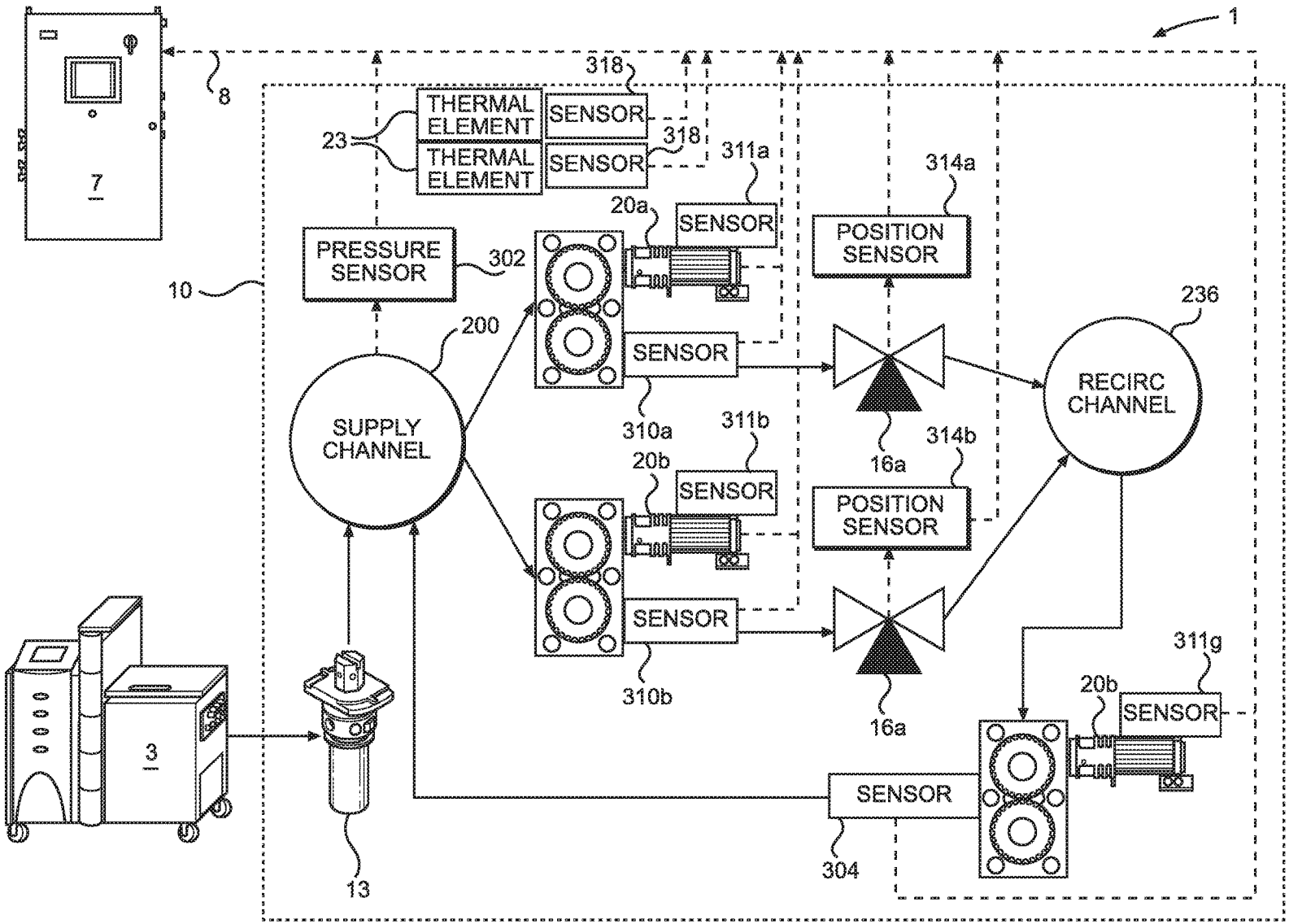
FIG. 16 is a schematic diagram of the dispensing system shown in FIG. 1 with related sensing components according to an embodiment of the present disclosure.

Continuing with FIG. 16, a schematic diagram of a dispensing system 1 for controlling the operation of the pump assemblies 20*a*-20*g* is depicted, where solid lines indicate adhesive flow and dashed lines indicate signal transmission. Though only pump assemblies 20*a*, 20*b*, and 20*g* are shown in FIG. 16, the features and functionality described below related to pump assemblies 20*a*, 20*b*, and 20*g* are equally applicable to each of pump assemblies 20*a*-20*g*. Components that comprise the applicator 10 are schematically shown within the dashed line labeled with reference numeral 10. As depicted, adhesive is melted by the melter 3 and directed through a filter 13 to the supply channel 200 of the applicator 10, which is configured to provide the adhesive to each of the plurality of pump assemblies 20*a*-20*f*. The applicator 10 can include the first pressure sensor 302 that is configured to measure a pressure of the adhesive flowing through the supply channel 200 and send a signal to the controller 7 through the signal connection 8 that is representative of that pressure. The pressure sensor 302 can be a pressure transducer, though it is contemplated that any conventional type of pressure sensor that is suitable for measuring the pressure of a fluid can be utilized. Pressure transducers comprise devices that convert pressure into an analog electrical signal. Various types of pressure transducers can be utilized, such as a capacitive pressure transducer, digital output pressure transducer, voltage/current output pressure transducer, etc.

After the adhesive passes through the supply channel 200, it can be directed to each of the pump assemblies 20*a*-20*f*. As described above, each of the pump assemblies 20*a*-20*f* is configured to pump the adhesive to a respective one of the dispensing modules 16*a*-16*f*. As such, each of the pump assemblies 20*a*-20*f* can pump the adhesive at a respective operating speed that can be the same or different than any of the other pump assemblies 20*a*-20*f*. As stated above, the applicator 10 can include a plurality of pressure sensors 310*a*-310*f* configured to detect the pressure of the adhesive pumped to the respective dispensing modules 16*a*-16*f* and send signals to the controller 7 through the signal connection 8 that is representative of those pressures. Accordingly, the operating speed of any of the pump assemblies 20*a*-20*f* can be individually adjusted by the controller 7, which is in signal communication with each of the pump assemblies 20*a*-20*f*. The controller 7 can be configured to detect the current draw of each of the plurality of pump assemblies 20*a*-20*f*. The current draw from each of the pump assemblies 20*a*-20*g* may fluctuate throughout a dispensing process as the pump assemblies 20*a*-20*g* are forced to draw more or less current in order to maintain a particular operating speed. This fluctuation in current draw can be indicative to a user of a change within the applicator 10, such as changed viscosity in the material.

After providing the material to the dispensing modules 16*a*-16*f*, each of the dispensing modules 16*a*-16*f* is configured to selectively dispense the material from the applicator 10. In particular, as described above, each of the dispensing modules 16*a*-16*f* includes a respective valve stem 260 that is configured to transition back and forth along a linear path, also referred to as a valve stroke, to control flow of adhesive from each of the plurality of dispensing modules 16*a*-16*f*. Like the pump assemblies 20*a*-20*f*, the dispensing modules 16*a*-16*f* can be affected by a change in the dispensing system 1, such as a clog or property change in the material flowing through the dispensing system 1. In particular, the length of time required for each valve stem 260 to travel through a complete stroke length may be affected. To monitor this, the applicator 10 can include a plurality of position sensors 314*a*-314*f* configured to measure an instantaneous position of a valve stem 260 of a corresponding one of the dispensing modules 16*a*-16*f* and send a signal to the controller 7 through the signal connection 8 that is representative of the instantaneous position. The positions sensors 314*a*-314*f* can be fiberoptic sensors configured to measure the change in intensity of light reflected from a component connected to the respective valve stems 260, though it is contemplated that any conventional type of position sensor that is suitable for measuring the instantaneous position of the valve stems 260 can be utilized. Though only position sensors 314*a*, 314*b* are shown, the applicator 10 can include a position sensor 314*a*-314*f* that corresponds to each of the dispensing modules 16*a*-16*f*. For example, the position sensor 314*a* can be configured to measure the instantaneous position of the valve stem 260 of the dispensing module 16*a*, the position sensor 314*b* can be configured to measure the instantaneous position of the valve stem 260 of the dispensing module 16*b*, etc. The valve stroke may fluctuate through a dispensing process as the fluid properties of the adhesive changes, clogs or dried material builds up within the applicator 10, etc.

As described previously, during periods in which the dispensing modules 16*a*-16*f* are not dispensing material from the applicator 10, they can direct the material to a recirculation channel 236. This recirculation channel 236 can direct this recirculated material from each of the dispensing modules 16*a*-16*f* back to the supply channel 200. Like the first pressure sensor 302 associated with the supply channel 200, the applicator 10 can include a second pressure sensor 304 that is configured to measure a pressure of the adhesive flowing through the recirculation channel 236 and send a signal to the controller 7 through the signal connection 8 that is representative of that pressure. The second pressure sensor 304 can be a pressure transducer, though it is contemplated that any conventional type of pressure sensor that is suitable for measuring the pressure of a fluid can be utilized.

As described above, the recirculation pump assembly 20*g* pumps the material through the recirculation channel 236 and otherwise control the flow of the adhesive through the recirculation channel 236. The controller 7 can be in signal communication with the recirculation pump assembly 20*g* through the signal connection 8 and be configured to detect the current draw of the recirculation pump assembly 20*g*. The current draw from the recirculation pump assembly 20*g* may fluctuate throughout a dispensing process as the recirculation pump assembly 20*g* is forced to draw more or less current in order to maintain a particular recirculation material flow rate. This fluctuation in current draw can be indicative to a user of a change within the applicator 10, such as changed viscosity in the material or a clog within the recirculation channel 236.

The applicator 10 can also include pump sensors 311*a*-311*f* and a recirculation pump sensor 311*g* configured to detect other aspects of the pump assemblies 20*a*-20*f* and recirculation pump assembly 20*g*, respectively, other than the current draw in order to accurately monitor the flow of material. For example, the pump sensors 311*a*-311*f* and recirculation pump sensor 311*g* can include sensors that measure motor torque and operating speed of the pump assemblies 20*a*-20*f* and recirculation pump assembly 20*g* or the pressure of the adhesive exiting the pump assemblies 20*a*-20*f* and recirculation pump assembly 20*g*, and likewise send a signal to the controller 7 that is representative of these various measurements. As such, pump sensors 311*a*-311*f* and recirculation pump sensor 311*g* can be optical encoders or Hall effect sensors. Measurement of these factors can be performed by the pump sensors 311*a*-311*f* and recirculation pump sensor 311*g* on a continuous or intermittent basis, which may be selectable or altered by the operator.

Continuing with FIG. 16, as previously described the applicator 10 can include a plurality of thermal elements 23 for heating the manifold 12 of the applicator 10, and likewise the material flowing through the applicator 10. The thermal elements 23 can be cartridge style, Kapton wire, cast-in, or induction coil heating elements, though any type of conventional heater is contemplated. The thermal elements 23 can function to maintain the material at an elevated temperature, which aids in maintaining the fluid properties of the material and thus allowing it to easily flow through the applicator. Many conventional applicators have a single thermal element, and thus only define a single zone of heating. However, the thermal elements 23 can create multiple heating zones throughout the applicator 10 so as to allow more localized and precise control over heating within specific parts of the applicator 10. The thermal elements 23 can be positioned at various locations throughout the applicator 10 such that the material is evenly heated as it flows through the applicator 10. Though only two thermal elements 23 are schematically shown, the applicator 10 can include one, three, four, or five or more thermal elements 23. The applicator 10 can also include plurality of heat sensors 318, where each of the heat sensors 318 corresponds to a respective one of the plurality of thermal elements 23. The heat sensors 318 can be in fluid communication with the material so as to detect a temperature of the material in the vicinity of the corresponding thermal element 23 and transmit a heat signal to the controller 7 that is representative of the temperature of the material. The heat sensors 318 can be nickel or platinum resistance temperature detectors or thermocouples, though any type of conventional heat sensor is contemplated. The controller 7 can utilize the measurements from the heat sensors 318 to determine a property of the material, such as the material's viscosity.

The controller 7 can be configured to receive signals from the first and second pressure sensors 302, 304, the pressure sensors 310*a*-310*f*, the position sensors 314*a*-314*f*, and heat sensors 318 that correspond to various parameters of the adhesive and components within the applicator 10 in order to determine how to control the pump assemblies 20*a*-20*f*, recirculation pump assembly 20*g*, and thermal elements 23. In particular, the controller 7 can determine an adjustment to the operating speed of each of the plurality of pump assemblies 20*a*-20*f* individually based on their respective current draws, and subsequently direct each of the plurality of pump assemblies 20*a*-20*f* to individually adjust their operating speed. An increase or decrease in current draw can indicate to the operator that a change within the applicator 10, such as a change in properties of the adhesive, has occurred. As a result, the operator may find it desirable to increase or decrease the operating speed of any of the pump assemblies 20*a*-20*f* to maintain dispensing consistency.

An adjustment to the operating speed of any of the pump assemblies 20*a*-20*f* can be automatically be made by the controller 7 upon detecting a deviation between an intended or preset current draw and the actual current draw detected by the controller 7. Alternatively, the controller 7 can be configured to direct each of the plurality of pump assemblies 20*a*-20*f* to individually adjust their operating speeds when their respective current draws are outside a predetermined range. For example, this range can be about plus or minus 0.1-10 Amps, though a typical value can be about 0.25 Amps. This range therefore defines an acceptable range within which the current draw may vary. Such a range can be preselected by the operator or automatically determined by the controller 7 based upon factors such as the material to be dispensed, the dispensing operation to be performed, the substrate onto which the material will be dispensed, etc. To preselect the range, the HMI device 7*a* can be configured to receive a user input that allows an operator to manually select the predetermined range. The operator may also be able to freely adjust the range at any time throughout a dispensing process. In addition to adjusting the operating speeds of the plurality of pump assemblies 20*a*-20*f* when their respective current draws are outside the predetermined range, the HMI device 7*a* can also be configured to produce an alert when the current draw of at least one of the plurality of pump assemblies 20*a*-20*f* is outside the predetermined range. The alert can notify the operator of the issue within the applicator 10 and inform the operator that human intervention may be required in order to rectify the issue. Likewise, as the controller 7 can be configured to direct each of the plurality of pump assemblies 20*a*-20*f* to individually adjust their operating speeds when their respective current draws are outside a predetermined range, the controller 7 can also be configured to direct each of the plurality of pump assemblies 20*a*-20*f* to maintain their operating speeds when their respective current draws are within a predetermined range. This allows the pump assemblies 20*a*-20*f* to continue operating despite small variations in current draw that may be indicative of issues inconsequential enough to not appreciably affect the quality or consistency of the dispensed material.

Though adjustments to the pump assemblies 20*a*-20*f* have been specifically described, the recirculation pump assembly 20*g* can be similarly operated. The controller 7 is configured to determine an adjustment to the operating speed of the recirculation pump assembly 20*g* based on the current draw from the recirculation pump assembly 20*g* as detected by the controller 7. An adjustment to the operating speed of the recirculation pump assembly 20*g* can be automatically made by the controller 7 upon detecting a deviation between an intended or preset current draw and the actual current draw measured by the controller 7, or when the measured current draw is outside a predetermined operating range. Likewise, the controller 7 can be configured to direct the recirculation pump assembly 20*g* to maintain its operating speed when its current draw is within the predetermined range.

Though adjusting the operating speeds of the pump assemblies 20*a*-20*f* and recirculation pump assembly 20*g* is discussed above with consideration of their respective current draws, the controller 7 can also take into consideration various other measurements when making these determinations. For instance, the controller 7 can be configured to determine the adjustment to the operating speed of each of the plurality of pump assemblies 20*a*-20*f* and recirculation pump assembly 20*g* individually based on the pressure of the adhesive flowing through the supply channel 200, as measured by the first pressure sensor 302. Additionally, the controller 7 can be configured to determine the adjustment to the operating speed of each of the plurality of pump assemblies 20*a*-20*f* and recirculation pump assembly 20*g* individually based on the pressure of the adhesive flowing through the recirculation channel 236, as measured by the second pressure sensor 304. Further, the controller 7 can be configured to determine the adjustment to the operating speed of each of the plurality of pump assemblies 20*a*-20*f* and recirculation pump assembly 20*g* individually based on the pressure of the adhesive being pumped to the dispensing modules 16*a*-16*f*, as measured by the pressure sensors 310*a*-310*f*.

In addition to determining an adjustment to the operating speed of the pump assemblies 20*a*-20*f* and the recirculation pump assembly 20*g*, the controller 7 can also process the measurements made by the various sensors and, through process of elimination and comparison to predetermined values, identify a specific defect that exists within the applicator 10. For example, based on measurements performed by the pressure sensors 302, 304, the pressure sensors 310*a*-310*f*, the position sensors 314*a*-314*f*, and the heat sensors 318, the controller 7 can identify specific problems occurring within the applicator 10. When a particular issue has been identified by the controller 7, the controller 7 can automatically perform adjustments to address the issue, as well as produce an alert via the HMI device 7*a* that indicates the problem to the operator and allows the operator to manually take corrective action. The alert can be a noise, vibration, light output, text notification, etc.

For example, when the speed of the pump assemblies 20*a*-20*f* is below a predetermined setpoint, the current draw of the pump assemblies 20*a*-20*f* increases, the pressure detected by the pressure sensors 310*a*-310*f* increases, and a temperature sensed by any of the heat sensors 318 is below a setpoint, the controller 7 can recognize the cause of these factors as an increase in viscosity of the adhesive. Conversely, when the speed of the pump assemblies 20*a*-20*f* is above a predetermined setpoint, the current draw of the pump assemblies 20*a*-20*f* decreases, the pressure detected by the pressure sensors 310*a*-310*f* decreases, and the temperature sensed by any of the heat sensors 318 is above a setpoint, the controller 7 can recognize the cause of these factors as a decrease in viscosity of the adhesive. When the current draw of the pump assemblies 20*a*-20*f* increases and the pressure detected by the pressure sensors 310*a*-310*f* increases, the controller 7 can recognize the cause of these factors as a clog in at least one of the nozzles 21. When pressure detected by the pressure sensors 310*a*-310*f* increases and the temperature sensed by any of the heat sensors 318 is below a setpoint, the controller 7 can recognize the cause of these factors as a failure of one or more of the thermal elements 23. In a situation where the speed of the pump assemblies 20*a*-20*f* is below a predetermined setpoint, the current draw of the pump assemblies 20*a*-20*f* increases, and the pressure detected by the pressure sensors 310*a*-310*f* decreases, the controller 7 can recognize the cause of these factors as a control failure in the pump assemblies 20*a*-20*f*. In a situation where the speed of the pump assemblies 20*a*-20*f* is both above and below a predetermined setpoint and the current draw of the pump assemblies 20*a*-20*f* increases, the controller 7 can recognize the cause of these factors as a failure in the control of the pump assemblies 20*a*-20*f*.

Additionally, when the current draw of the pump assemblies 20*a*-20*f* decreases, the pressure detected by the pressure sensors 310*a*-310*f* decreases, and the temperature sensed by any of the heat sensors 318 is above a setpoint, the controller 7 can recognize the cause of these factors as a failure in the control of the thermal elements 23. When the current draw of the pump assemblies 20*a*-20*f* decreases, the pressure detected by the pressure sensors 310*a*-310*f* decreases, and the time that the valve stem 260 of any of the dispensing modules 16*a*-16*f* is in the first position is above nominal as detected by the position sensors 314*a*-314*f*, the controller 7 can recognize the cause of these factors as an increase in the interval duration that a solenoid (not labeled) is actuating the valve stem 260. When the current draw of the pump assemblies 20*a*-20*f* increases, the pressure detected by the pressure sensors 310*a*-310*f* increases, and the time that the valve stem 260 of any of the dispensing modules 16*a*-16*f* is in the first position is below nominal as detected by the position sensors 314*a*-314*f*, the controller 7 can recognize the cause of these factors as a decrease in the interval duration that the solenoid is actuating the valve stem 260 or a failure of one of the valve stems 260. In a situation where the current draw of the pump assemblies 20*a*-20*f* decreases and the time that the valve stem 260 of any of the dispensing modules 16*a*-16*f* is in the first position is above nominal as detected by the position sensors 314*a*-314*f*, the controller 7 can recognize the cause of these factors as the wearing out of a component of the dispensing modules 16*a*-16*f*. Though multiple problems that can occur within the applicator 10 and potential causes of these problems are described above, this listing is not intended to be exhaustive in both the type of problems the controller 7 can recognize and the potential causes of these problems.

Figure 17:
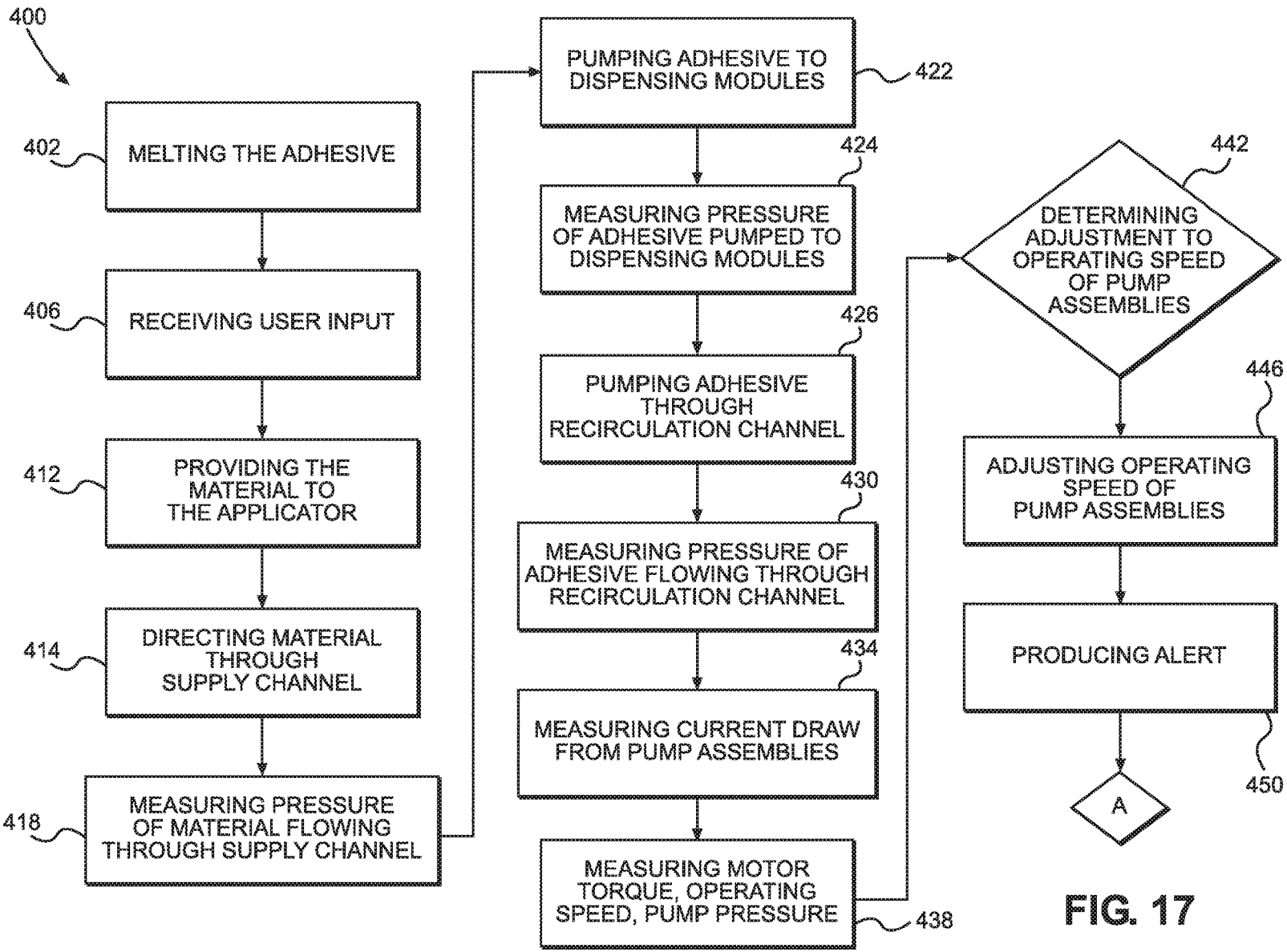
FIG. 17 is a process flow diagram of a method for controlling the dispensing of adhesive from the applicator the and related sensing components shown in FIG. 16.

Continuing with FIGS. 17-18, a method 400 of controlling the dispensing of adhesive from the applicator 10 utilizing the components described in relation to FIG. 16 will be described. Method 400 includes step 402, in which the adhesive is melted by the melter 3. At any time during, before, or after the melter 3 melts the adhesive, the operator can manually input one or more predetermined acceptable ranges for the current draws of the pump assemblies 20*a*-20*f* and/or the recirculation pump assembly 20*g* in step 406. Alternatively, the acceptable range can be determined by the controller 7 based on the adhesive to be dispensed, the particular dispensing operation to be performed, etc. In step 412, the melter 3 can provide the melted adhesive to the applicator 10, such as through the hose 5. Once the applicator 10 receives the melted adhesive, in step 414 the adhesive is directed through the supply channel 200 to the pump assemblies 20*a*-20*f*. While the adhesive is being directed through the supply channel 200, in step 418 the first pressure sensor 302 can measure the pressure of the adhesive flowing through the supply channel 200 and send a signal to the controller 7 that is representative of this measured pressure.

After step 418, the adhesive is pumped to the dispensing modules 16*a*-16*f* via the pump assemblies 20*a*-20*f*, respectively in step 422. In step 424, the pressure sensors 310*a*-310*f* can measure the pressure of the adhesive pumped by the pump assemblies 20*a*-20*f* to the dispensing modules 16*a*-16*f*. The pressure of the material flowing to the dispensing modules 16*a*-16*f* can be utilized by the controller 7 to determine the adjustment to the operating speed of each of the plurality of pump assemblies 20*a*-20*f* and the recirculation pump assembly 20*g*. As described above, the dispensing modules 16*a*-16*f* are configured to selectively dispense the adhesive onto a substrate through reciprocation of the respective valve stems 260 of the dispensing modules 16*a*-16*f*. When the valve stems 260 prevent adhesive from being applied to the substrates, the adhesive is pumped from the plurality of dispensing modules 16*a*-16*f* through a recirculation channel 236 and back to the supply channel 200 via the recirculation pump assembly 20*g* in step 426, which allows this adhesive to be recycled back through the applicator 10 and again supplied to the pump assemblies 20*a*-20*f*. While the adhesive is being pumped through the recirculation channel 236 by the recirculation pump assembly 20*g*, in step 430 the second pressure sensor 304 can measure the pressure of the adhesive flowing through the recirculation channel 236 and send a signal to the controller 7 that is representative of this measured pressure. Like the pressure of the material flowing through the supply channel 200, the pressure of the material flowing through the recirculation channel 236 as measured by the pressure sensor 304 can be utilized by the controller 7 to determine the adjustment to the operating speed of each of the plurality of pump assemblies 20*a*-20*f* and the recirculation pump assembly 20*g* individually.

While the pump assemblies 20*a*-20*f* are pumping the adhesive, in step 434 the controller 37 can measure the current draw from each of the pump assemblies 20*a*-20*f*. The current draw of any of the pump assemblies 20*a*-20*f* can fluctuate over time in response to changed conditions within the applicator 10 in order to maintain a consistent, set operating speed of each of the pump assemblies 20*a*-20*f*. Following or concurrently with step 434, in step 438 the pump sensors 311*a*-311*f* can measure other parameters related to the pump assemblies 20*a*-20*f*, such as motor torque, operating speed, and pump pressure of each of the plurality of pump assemblies 20*a*-20*f*. After steps 434 and/or 438 are performed, in step 442 the controller 7 can determine an adjustment to an operating speed of each of the pump assemblies 20*a*-20*f* based on their respective current draws. This adjustment can be determined individually by the controller for each of the pump assemblies 20*a*-20*f*, and in addition to the current draw, can be based each of their unique measured motor torques, operating speeds, pump pressures, etc. In one embodiment, step 442 can include determining an adjustment to the operating speed of the pump assemblies 20*a*-20*f* only when the current draw of any of the pump assemblies 20*a*-20*f* are outside a predetermined range. As stated above, this range can be about plus or minus 0.1-10 Amps, though other ranges are contemplated. Likewise, step 442 can included maintaining the operating speed of each of the plurality of pump assemblies 20*a*-20*f* when their respective current draws are within the predetermined range.

After the adjustment to the operating speed of the pump assemblies 20*a*-20*f* has been determined in step 442, in step 446 the controller 7 can direct the pump assemblies 20*a*-20*f* to adjust their respective operating speeds individually in accordance with the determined adjustment. The operating speeds of any number of the pump assemblies 20*a*-20*f* can be adjusted or maintained, depending on the measurements made by the first and second sensors 302, 304 and pressure sensors 310*a*-310*f*, as well as the determinations made by the controller 7. At any time after step 442 is performed, and concurrently, before, or after step 446, an alert can be produced in step 450 when the current draw of one of the plurality of pump assemblies 20*a*-20*f* is outside the predetermined range. The alert can be produced by the HMI device 7*a* and take the form of a noise, vibration, light output, text notification, or any other type of conventional alert capable of notifying the operator that the current draw of one of the plurality of pump assemblies 20*a*-20*f* is outside the predetermined range.

Figure 18:
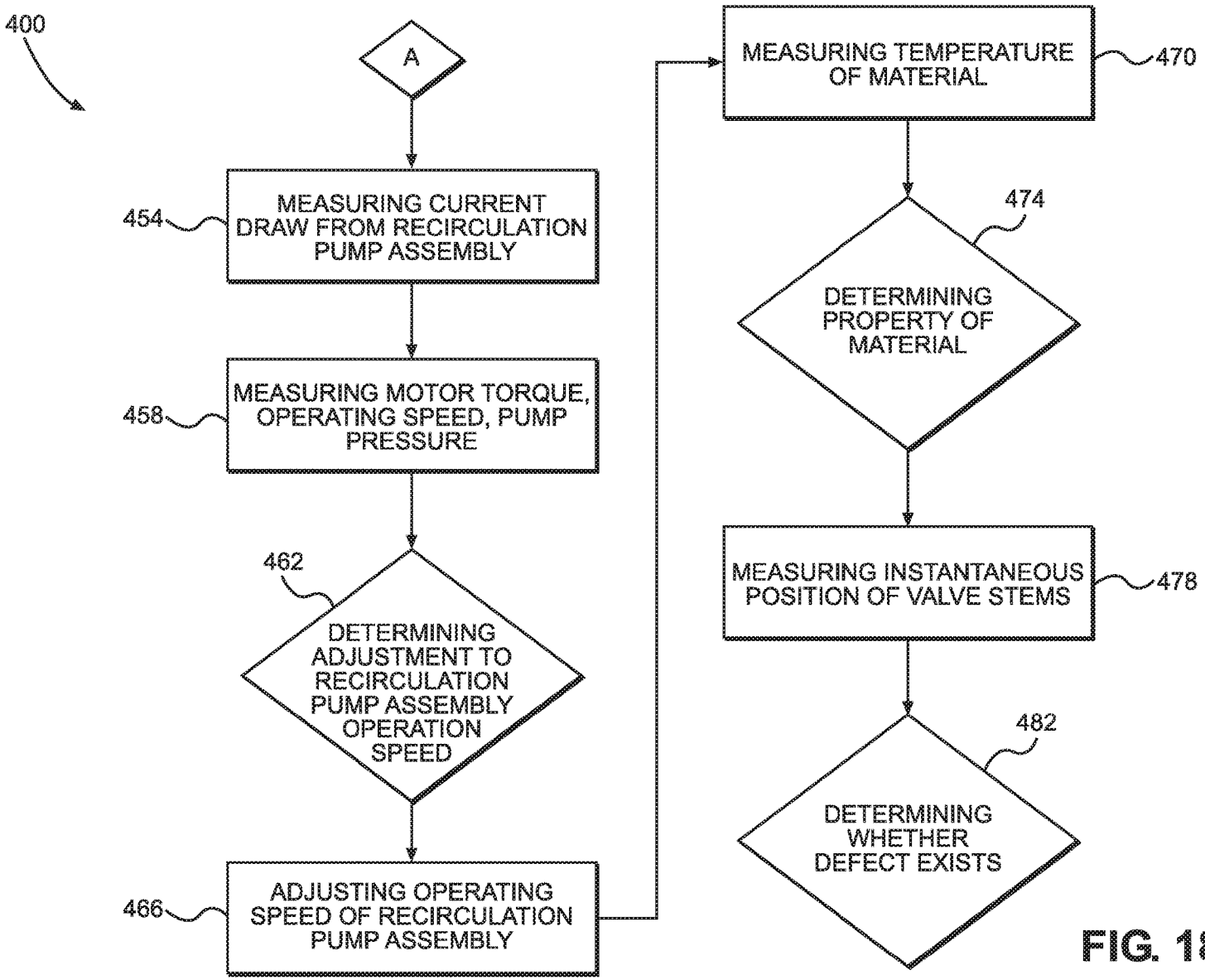
FIG. 18 is a process flow diagram of a continuation of the method for controlling the dispensing of adhesive from the applicator and the related sensing components shown in FIG. 17.

Continuing with FIG. 18, while the recirculation pump assembly 20*g* is pumping the adhesive through the recirculation channel 236, in step 454 the controller 7 can determine the current draw from the recirculation pump assembly 20*g* and simultaneously transmit a signal to the controller 7 that is indicative of the current draw of the recirculation pump assembly 20*g*. The current draw of any of the recirculation pump assembly 20*g* can fluctuate over time in order to maintain a consistent, set operating speed of the recirculation pump assembly 20*g* in response to changed conditions within the applicator 10. Following or concurrently with step 454, in step 458 the pump sensor 311*g* can measure other parameters related to the recirculation pump assembly 20*g*, such as motor torque, operating speed, and pump pressure of the recirculation pump assembly 20*g*. After steps 454 and/or 458 are performed, in step 462 the controller 7 can determine an adjustment to an operating speed of the recirculation pump assembly 20*g* based on its current draw. In addition to the current draw, this adjustment can be based on the motor torque, operating speed, pump pressures, etc. This adjustment can also be based on the pressures measured by the pressure sensors 310*a*-310*f*. In one embodiment, step 462 can include determining an adjustment to the operating speed of the recirculation pump assembly 20*g* only when the current draw of the recirculation pump assembly 20*g* is outside a predetermined range. As stated above, this range can be about plus or minus 0.1-10 Amps, though other ranges are contemplated. Likewise, step 462 can include maintaining the operating speed of the recirculation pump assembly 20*g* when its current draw is within the predetermined range. After the adjustment to the operating speed of recirculation pump assembly 20*g* has been determined in step 462, in step 466 the controller 7 can direct the recirculation pump assembly 20*g* to adjust its operating speed in accordance with the determined adjustment.

In step 470, the heat sensors 318 positioned within the vicinity of the thermal elements 23 can be configured to measure the temperature of the adhesive at different locations throughout the applicator 10 and transmit a heat signal to the controller 7 that is representative of the temperature of the adhesive. This measuring step can be performed at any time with respect to previously described steps 402-466, such that it can be performed simultaneously with the steps where the controller 7 determines adjustments to the operating speeds of the pump assemblies 20*a*-20*f* and the recirculation pump assembly 20*g*. After step 470 is performed, in step 474 the controller 7 can determine a property of the adhesive based on the temperature of the adhesive as detected by the heat sensors 318. For example, this property can be a viscosity of the adhesive, and can be determined by the controller 7 based upon the temperature measured by the heat sensors 318 and compared to known material properties of the adhesive, though other properties are contemplated.

The heat sensed in step 470 by the heat sensor 318 can also be utilized by the controller 7 in determining an adjustment to the operating speed of the pump assemblies 20*a*-20*f* and/or the recirculation pump assembly 20*g*.

In step 478, the position sensors 314*a*-314*f* are configured to measure an instantaneous position of a valve stem 260 of a corresponding one of the dispensing modules 16*a*-16*f* and send a signal to the controller 7 through the signal connection 8 that is representative of the instantaneous position. Like step 470, this measuring step can be performed at any time with respect to previously described steps 402-466, such that it can be performed simultaneously with the steps where the controller 7 determines adjustments to the operating speeds of the pump assemblies 20*a*-20*f* and the recirculation pump assembly 20*g*. Using the instantaneous positions of the valve stems 260 measured in step 478, in step 482 the controller 7 can determine whether a defect exists in the dispensing system. Such a defect can include a clog within the material flow path, component failure, etc., and can affect the positioning of the valve stems 260 by causing the time required for the valve stems 260 to complete a full stroke length to increase. In addition to the instantaneous position measured by the position sensors 314*a*-314*f*, the measurements measured by the first and second sensors 302, 304, pressure sensors 310*a*-310*f*, pump sensors 311*a*-311*f*, recirculation pump sensor 310*g*, and heat sensors 318 can also be utilized in making this determination. Further, the instantaneous position measured by the position sensors 314*a*-314*f* can also be utilized in the determination of the adjustment to the operating speed of the pump assemblies 20*a*-20*f* and/or the recirculation pump assembly 20*g*.

As the flow of adhesive to each dispensing module 16*a*-16*f* is individually controlled by a respective pump assembly 20*a*-20*f*, aspects of the flow of adhesive to an individual dispensing module 16*a*-16*f* can be adjusted without altering the operation of other portions of the dispensing system 1. The addition of the first and second sensors 302, 304, the pressure sensors 310*a*-310*f*, the position sensors 314*a*-314*f*, and the heat sensors 318 allow the flow of adhesive within the applicator 10 to be monitored with a higher level of precision and a higher resolution, while simultaneously allowing changes or issues within the applicator 10 to be reacted to quicker. The ability of the controller 7 to receive and utilize the entirety of the measurements taken by the above-described sensors allows the controller 7 to react faster than prior systems when a change within the applicator 10 must be made and adjust operation of any combination of the pump assemblies 20*a*-20*f* and/or recirculation pump assembly 20*g*, which can save on wasted adhesive and result in less unsalable finished product.

Figure 19:
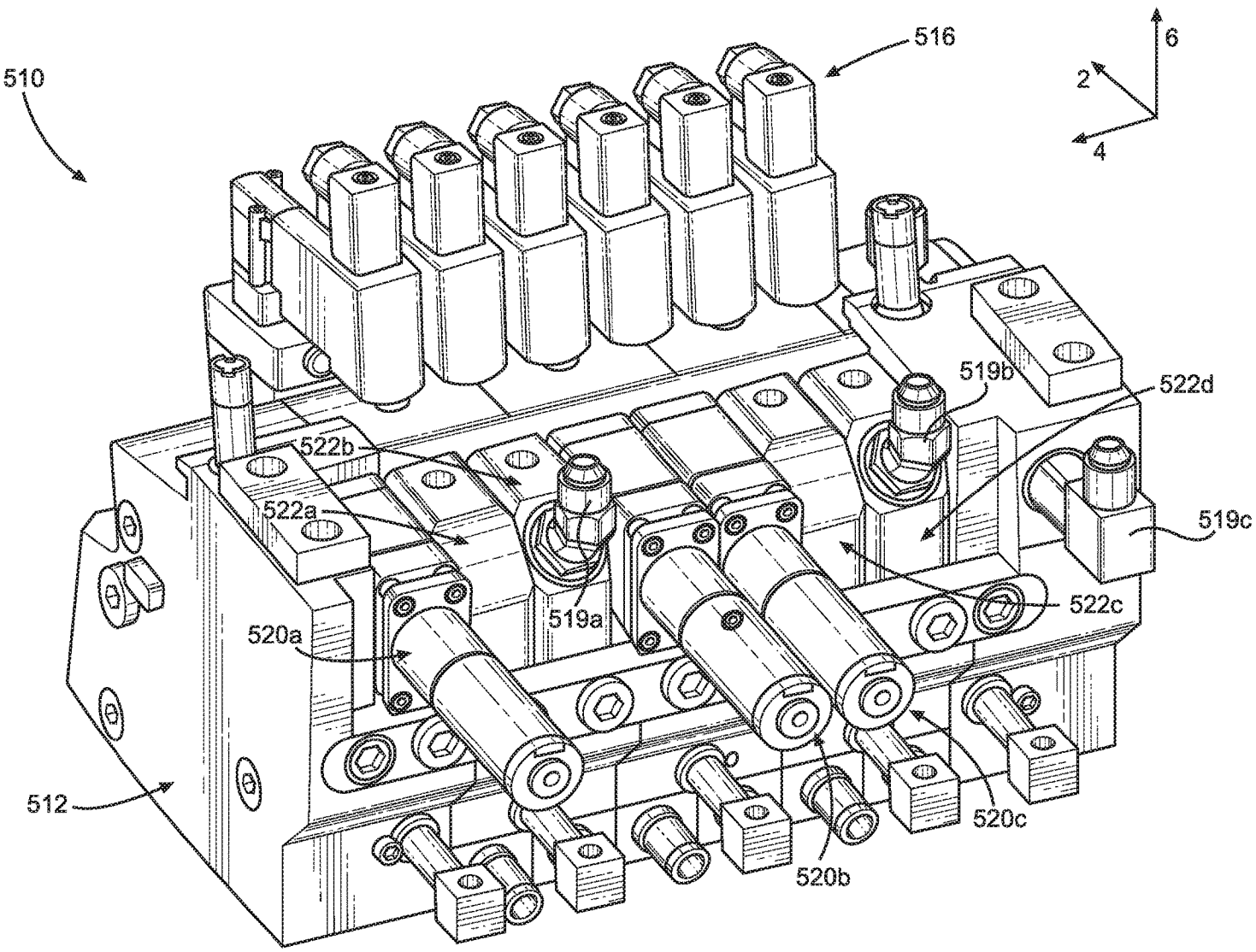
FIG. 19 is a rear perspective view of an applicator according to another embodiment of the present invention.

Another embodiment of the present disclosure is a hybrid applicator for dispensing the adhesive. FIG. 19 illustrates an applicator 510. The hybrid applicator 510 is configured for both metered output and pressure fed output. The applicator 510 is similar to the applicator 10 described above. For instance, the hybrid applicator 510 includes dispensing module(s) 516 and a unitary or segmented manifold 512.

The hybrid applicator 510 includes at least one pump assembly 420 (or pump assembly 120) and at least one pressure feed block 520, each of which is coupled to the manifold 512. Regarding this embodiment, reference number 420 can be used interchangeably with the reference number 520*a*-520*c* unless noted otherwise. In accordance with the embodiment illustrated in FIG. 16, the applicator 10 includes three pump assemblies 520*a*, 520*b* and 520*c*, as well as four pressure feed blocks 522*a*, 522*b*, 522*c* and 522*d*. However, the applicator 510 can include any number of pump assemblies 420 and pressure feed blocks 520. Any of the pump assemblies 520*a*-520*c* can be configured to operate as the recirculation pump assembly, as described in relation to pump assembly 20*g* above.

Continuing with FIG. 19, the pump assembly 420 is substantially the same as pump assembly 20 (or pump assembly 120), as described above. The pump assembly 420 receives adhesive from flow channels in the manifold 512, which are ported to the input 519*c*. Pressure feed blocks 522*a* and 522*c* include inlets and outlets that receive adhesive from the manifold supplied through the input 519*c*. The pressure feed blocks 522*b* and 522*d* are supplied adhesive through inputs 519*a* and 519*b*, which receive adhesive from an adhesive supply (not shown). A pump (not shown) near the adhesive supply may be used to feed the adhesive through hoses to inputs 519*a* and 519*b*, which are coupled to the pressure feed blocks 522*b* and 522*d*, respectively. Heat from the manifold 512 then is transferred to the pressure feed blocks 522*a*-522*d*, thereby heating the adhesive within the pressure feed block 520. As shown, the hybrid applicator 510 has multiple input fittings 519*a*-519*c*, some which are associated with a pressure feed block(s), that can be used to supply different types of adhesive to the applicator 510.

Combining a pump assembly 420 with a pressure feed block 520 increases process flexibility of the applicator 510. For example, the pump assembly 420 permits precise metering of adhesive streams from the dispensing module 516, while other adhesive streams are associated with the less precise pressure feed blocks 520. It should be appreciated that the hybrid applicator 510 can be metered, pressure-fed, and multi-zone pressure-fed, all within a single manifold as needed.

While the invention is described herein using a limited number of embodiments, these specific embodiments are not intended to limit the scope of the invention as otherwise described and claimed herein. The precise arrangement of various elements and order of the steps of articles and methods described herein are not to be considered limiting. For instance, although the steps of the methods are described with reference to sequential series of reference signs and progression of the blocks in the figures, the method can be implemented in any particular order as desired.

What is claimed is:

1. A dispensing system for dispensing adhesive, the dispensing system comprising:

an applicator comprising:

a manifold;

a plurality of dispensing modules coupled to said manifold; and a plurality of pump assemblies, wherein each of the plurality of pump assemblies is configured to pump the adhesive to a respective one of the plurality of dispensing modules at a respective operating speed; and a controller in signal communication with the applicator, wherein the controller is configured to a) measure current draw from each of the plurality of pump assemblies, b) determine an adjustment to the operating speed of each of the plurality of pump assemblies individually based on their respective current draws, and c) direct each of the plurality of pump assemblies to individually adjust their operating speed.

2. The dispensing system of claim 1, wherein the applicator further comprises:

a supply channel configured to provide the adhesive to the plurality of pump assemblies;

a recirculation channel configured to receive the adhesive from the plurality of pump assemblies and direct the adhesive to the supply channel; and a recirculation pump assembly configured to control flow of the adhesive through the recirculation channel.

3. The dispensing system of claim 2, wherein the applicator further comprises:

a plurality of pressure sensors each configured to measure a pressure of the adhesive pumped from a respective one of the plurality of pumps to a corresponding one of the plurality of dispensing modules, and send a signal to the controller that is representative of the pressure.

4. The dispensing system of claim 3, wherein the applicator further comprises:

a recirculation pressure sensor configured to measure a pressure of the adhesive flowing through the recirculation channel and send a signal to the controller that is representative of the pressure, wherein the controller is configured to determine an adjustment to an operating speed of the recirculation pump assembly so as to equalize the pressure measured by the recirculation pressure sensor and the pressures measured by the pressure sensors.

5. The dispensing system of claim 2, wherein the controller is in signal communication with the recirculation pump assembly, the controller being further configured to measure current draw from the recirculation pump assembly and determine an adjustment to the operating speed of the recirculation pump assembly based on the current draw from the recirculation pump assembly.

6. The dispensing system of claim 5, wherein the applicator further comprises a plurality of pump sensors and a recirculation pump sensor, wherein the plurality of pump sensors and the recirculation pump sensor are configured to measure motor torque and operating speed of the plurality of pump assemblies and recirculation pump assembly, respectively, and a pump pressure of the adhesive exiting the plurality of pump assemblies and the recirculation pump assembly, respectively.

7. The dispensing system of claim 1, wherein each of the plurality of dispensing modules includes a valve stem that is configured to control flow of adhesive from the plurality of dispensing modules, the applicator further comprising:

a plurality of position sensors, wherein each of the plurality of position sensors is configured to measure an instantaneous position of a respective one of the valve stems and send a position signal to the controller that is representative of the instantaneous position of the respective one of the valve stems, wherein the controller is configured to determine whether a defect exists in the dispensing system based on the instantaneous positions.

8. The dispensing system of claim 1, wherein the applicator further comprises:

a plurality of thermal elements for heating the adhesive; and a plurality of heat sensors, wherein each of the plurality of heat sensors is positioned adjacent a respective one of the plurality of thermal elements and in fluid communication with the adhesive, such that the plurality of thermal elements are configured to detect a temperature of the adhesive and transmit a heat signal to the controller that is representative of the temperature of the adhesive, wherein the controller is configured to determine a property of the adhesive based on the temperature of the adhesive.

9. The dispensing system of claim 1, wherein the controller is configured to direct each of the plurality of pump assemblies to individually adjust their operating speeds when their respective current draws are outside a predetermined range.

10. The dispensing system of claim 9, wherein the controller is configured to direct each of the plurality of pump assemblies to individually maintain their operating speeds when their respective current draws are within the predetermined range.

11. The dispensing system of claim 9, wherein the controller includes a human-machine interface (HMI) device configured to produce an alert when the current draw of one of the plurality of pump assemblies is outside the predetermined range.

12. The dispensing system of claim 11, wherein the HMI device is configured to receive a user input to manually select the predetermined range.

13. The dispensing system of claim 1, further comprising:

a melter configured to melt the adhesive and provide the adhesive to the applicator.

14. A method of controlling dispensing of adhesive from an applicator, comprising:

pumping adhesive from a plurality of pump assemblies to a plurality of dispensing modules;

measuring current draw from each of the plurality of pump assemblies;

determining an adjustment to an operating speed of each of the plurality of pump assemblies individually based on their respective current draws; and adjusting the operating speed of each of the plurality of pump assemblies individually.

15. The method of claim 14, further comprising:

directing the adhesive through a supply channel to the plurality of pump assemblies; and pumping the adhesive from the plurality of dispensing modules through a recirculation channel and to the supply channel via a recirculation pump assembly.

16. The method of claim 15, further comprising:

measuring a recirculation pressure of the adhesive flowing through the recirculation channel;

measuring a dispensing pressure of the adhesive flowing from each of the plurality of pump assemblies to the respective one of the plurality of dispensing modules; and adjusting an operating speed of the recirculation pump assembly so as to equalize the recirculation pressure with the dispensing pressure.

17. The method of claim 15, further comprising:

determining current draw from the recirculation pump assembly;

determining an adjustment to an operating speed of the recirculation pump assembly based on the current draw; and adjusting the operating speed of the recirculation pump assembly.

18. The method of claim 17, further comprising:

measuring motor torque, operating speed, and pump pressure of the recirculation pump assembly, wherein determining the adjustment to the operating speed of the recirculation pump assembly includes determining the adjustment to the operating speed of the recirculation pump assembly based on the motor torque, operating speed, and pump pressure.

19. The method of claim 14, further comprising:

measuring motor torque, operating speed, and pump pressure of each of the plurality of pump assemblies, wherein determining the adjustment to the operating speed of each of the plurality of pump assemblies includes determining the adjustment to the operating speed of each of the plurality of pump assemblies individually based on the motor torque, operating speed, and pump pressure of each of the plurality of pump assemblies.

20. The method of claim 14, further comprising:

measuring an instantaneous position of a valve stem of each of the plurality of dispensing modules; and determining whether a defect exists in the applicator based on the instantaneous positions.

21. The method of claim 14, further comprising:

measuring a temperature of the adhesive; and determining a property of the adhesive based on the temperature of the adhesive.

22. The method of claim 14, wherein adjusting the operating speed of each of the plurality of pump assemblies individually includes adjusting the operating speed of each of the plurality of pump assemblies when their respective current draws are outside a predetermined range.

23. The method of claim 22, wherein adjusting the operating speed of each of the plurality of pump assemblies individually includes maintaining the operating speed of each of the plurality of pump assemblies when their respective current draws are within the predetermined range.

24. The method of claim 22, further comprising:

producing an alert when the current draw of one of the plurality of pump assemblies is outside the predetermined range.

25. The method of claim 22, further comprising:

receiving a user input to manually select the predetermined range.

* * * * *